US012728497B2

(12) United States Patent
Tajima et al.

(10) Patent No.: US 12,728,497 B2
(45) Date of Patent: Sep. 8, 2026

(54) SUBSTRATE SUCTION MEMBER, ELASTIC SEAL ASSEMBLY, TOP RING, AND SUBSTRATE PROCESSING APPARATUS

(71) Applicant: EBARA CORPORATION, Tokyo (JP)

(72) Inventors: Kazuhiro Tajima, Tokyo (JP); Makoto Kashiwagi, Tokyo (JP); Manato Furusawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 317 days.

(21) Appl. No.: 18/698,305

(22) PCT Filed: Oct. 7, 2022

(86) PCT No.: PCT/JP2022/037612
§ 371 (c)(1),
(2) Date: Apr. 3, 2024

(87) PCT Pub. No.: WO2023/058751
PCT Pub. Date: Apr. 13, 2023

(65) Prior Publication Data

US 2024/0416480 A1 Dec. 19, 2024

(30) Foreign Application Priority Data

Oct. 8, 2021 (JP) ..... 2021-166120
Oct. 4, 2022 (JP) ..... 2022-160497

(51) Int. Cl.
*B24B 37/32* (2012.01)
*B24B 37/04* (2012.01)
(Continued)

(52) U.S. Cl.
CPC ..... *B24B 37/32* (2013.01); *B24B 37/04* (2013.01); *B24B 53/007* (2013.01); *B24B 53/017* (2013.01); *B24B 57/02* (2013.01)

(58) Field of Classification Search
CPC ..... B24B 37/32; B24B 7/22
See application file for complete search history.

(56) References Cited

U.S. PATENT DOCUMENTS 5,398,459 A * 3/1995 Okumura ..... B24B 37/102 451/286
5,476,414 A * 12/1995 Hirose ..... H10P 90/129 451/388

(Continued)

FOREIGN PATENT DOCUMENTS

JP 3668529 B2 4/2005
JP 2020-168675 A 10/2020
JP 2021-079488 A 5/2021

OTHER PUBLICATIONS

International Patent Application No. PCT/JP2022/037612; Int'l Search Report dated Nov. 29, 2022; 2 pages.

(Continued)

*Primary Examiner* — Sean M Michalski
(74) *Attorney, Agent, or Firm* — BakerHostetler

(57) ABSTRACT

A substrate is reliably suctioned regardless of a flatness of a surface to be suctioned of the substrate. A substrate suction member 330 includes a porous member 334 including a substrate suction surface 334*a* for suctioning a substrate WF and a pressure reducer 334*b* communicating with pressure reducing means, a shielding member 332 including a first shielding member 332-1 configured to shield a surface 334*c* in an opposite side of the substrate suction surface 334*a* of the porous member 334 and a frame-shaped second shielding member 332-2 configured to shield at least a part of a side surface 334*d* of the porous member 334, and a frame-shaped elastic seal member 336 attached to the second shielding member 332-2 so as to surround the porous (Continued)

member 334 and provided with a contact surface 336*a* in contact with the substrate WF.

12 Claims, 15 Drawing Sheets

(51) Int. Cl.
*B24B 53/007* (2006.01)
*B24B 53/017* (2012.01)
*B24B 57/02* (2006.01)

(56) References Cited

U.S. PATENT DOCUMENTS 5,645,474 A * 7/1997 Kubo ..... B24B 37/32 451/388
5,670,011 A * 9/1997 Togawa ..... B24B 57/02 438/693
6,030,488 A * 2/2000 Izumi ..... B24B 37/30 451/388
6,033,292 A * 3/2000 Inaba ..... B24B 37/30 451/287
6,116,992 A * 9/2000 Prince ..... B24B 37/30 451/286
6,435,949 B1 * 8/2002 Katsuoka ..... B24B 37/30 451/288
RE38,878 E * 11/2005 Hirose ..... B24B 37/30 451/41
7,101,273 B2 * 9/2006 Tseng ..... B24B 37/30 451/288
8,591,286 B2 * 11/2013 Chen ..... B24B 37/30 451/286
11,701,750 B2 * 7/2023 Ishii ..... B24B 37/30 451/388
2002/0119735 A1 * 8/2002 Nakamura ..... B24B 37/30 451/287
2014/0170938 A1 * 6/2014 Duescher ..... B24B 37/30 451/41
2018/0281151 A1 * 10/2018 Ramaswami ..... B24B 37/32
2020/0316747 A1 10/2020 Kobayashi et al.
2021/0170543 A1 6/2021 Ishii et al.
2021/0402548 A1 * 12/2021 Mitsuya ..... B24B 37/005
2025/0229379 A1 * 7/2025 Shin ..... B24B 37/32
2026/0014669 A1 * 1/2026 Jain ..... B24B 37/30

OTHER PUBLICATIONS

European Patent Application No. 22878618.2; Extended Search Report; dated Oct. 8, 2025; 10 pages.

* cited by examiner

SUBSTRATE SUCTION MEMBER, ELASTIC SEAL ASSEMBLY, TOP RING, AND SUBSTRATE PROCESSING APPARATUS

TECHNICAL FIELD

This application relates to a substrate suction member, an elastic seal assembly, a top ring, and a substrate processing apparatus.

BACKGROUND ART

A chemical mechanical polishing (CMP) apparatus is used to planarize a surface of a substrate in manufacture of semiconductor devices. The substrate used in the manufacture of semiconductor devices often has a circular-plate shape. Not only for the semiconductor devices, but also for quadrangular substrates, such as copper clad laminate substrates (CCL substrates), printed circuit board (PCB) substrates, photomask substrates, and display panels, there is an increasing demand for flatness when the substrate surfaces are planarized. Further, there is an increasing demand for planarizing surfaces of package substrates on which electronic devices such as PCB substrates are arranged.

A substrate processing apparatus, such as a chemical mechanical polishing apparatus, includes a top ring for holding a substrate. For example, as described in PTL 1, the top ring includes a rotation shaft, a flange coupled to the rotation shaft, a porous suction plate fitted to an opening provided at a center in a lower surface of the flange, and a shielding plate attached on an upper surface of the suction plate. This top ring is configured to suction the substrate via micropores of the suction plate by vacuum suction and press the substrate against a polishing pad by applying a pressure to the shielding plate.

CITATION LIST

Patent Literature

PTL 1: Japanese Patent No. 3668529

SUMMARY OF INVENTION

Technical Problem

The top ring of the prior art as disclosed in PTL 1 has a room for improvement in reliably suctioning the substrate regardless of the flatness of a surface to be suctioned of the substrate.

That is, the top ring of the prior art can suction the substrate to the suction plate by vacuum suction when the surface to be suctioned of the substrate is flat. In contrast, when the surface to be suctioned is not flat, for example, a part of an outer peripheral portion of the surface to be suctioned of the substrate is depressed, air leakage from a gap generated by depression decreases the suction force, resulting in failure in suctioning the substrate to the suction plate in some cases.

Therefore, it is one object of this application to reliably suction a substrate regardless of a flatness of a surface to be suctioned of the substrate.

Solution to Problem

According to one embodiment, a substrate suction member is disclosed. The substrate suction member includes a porous member, a shielding member, and a frame-shaped elastic seal member. The porous member includes a substrate suction surface for suctioning a substrate and a pressure reducer communicating with pressure reducing means. The shielding member includes a first shielding member configured to shield a surface in an opposite side of the substrate suction surface of the porous member and a frame-shaped second shielding member configured to shield at least a part of a side surface of the porous member. The elastic seal member is attached to the second shielding member so as to surround the porous member and provided with a contact surface in contact with the substrate.

DESCRIPTION OF EMBODIMENTS

Figure 1:
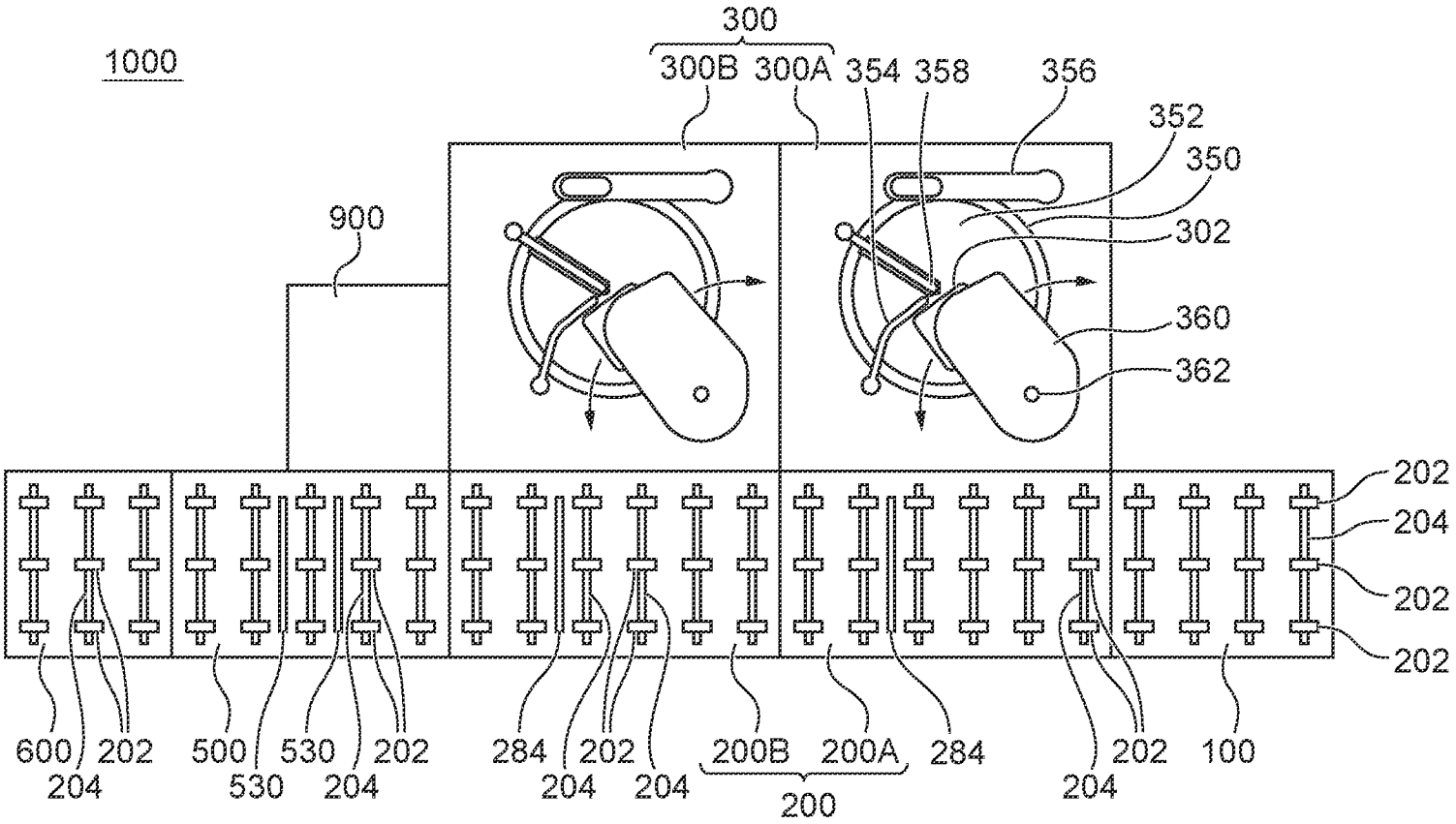
FIG. 1 is a plan view illustrating an overall configuration of a substrate processing apparatus according to one embodiment.

The following describes embodiments of a substrate suction member, an elastic seal assembly, a top ring, and a substrate processing apparatus according to the present invention with attached drawings. In the attached drawings, identical or similar reference numerals are given to identical or similar components, and in an explanation of each embodiment, overlapping explanations regarding the identical or similar components will be omitted in some cases. Features indicated in each embodiment are also applicable to other embodiments as long as it does not conflict with one another.

FIG. 1 is a plan view illustrating an overall configuration of a substrate processing apparatus 1000 according to one embodiment. The substrate processing apparatus 1000 illustrated in FIG. 1 includes a loading unit 100, a transfer unit 200, a polishing unit 300, a drying unit 500, and an unloading unit 600. In the illustrated embodiment, the transfer unit 200 includes two transfer units 200A and 200B, and the polishing unit 300 includes two polishing units 300A and 300B. In the one embodiment, each of these units can be formed independently. By forming these units independently, appropriately combining the number of each unit can facilitate formation of the substrate processing apparatuses 1000 having different configurations. Further, the substrate processing apparatus 1000 includes a controller 900, and each component of the substrate processing apparatus 1000 is controlled by the controller 900. In the one embodiment, the controller 900 can be configured of a general computer including an input/output device, an arithmetic device, a storage device, and the like.

<Loading Unit>

The loading unit 100 is a unit for introducing a substrate WF before processing, such as polishing and cleaning, is performed into the substrate processing apparatus 1000. In the one embodiment, the loading unit 100 is configured to comply with Mechanical Equipment Interface Standard (IPC-SMEMA-9851) of Surface Mount Equipment Manufacturers Association (SMEMA).

In the illustrated embodiment, a transfer mechanism of the loading unit 100 includes a plurality of transfer rollers 202 and a plurality of roller shafts 204 to which the transfer rollers 202 are mounted. In the embodiment illustrated in FIG. 1, three transfer rollers 202 are mounted on each roller shaft 204. The substrate WF is arranged on the transfer rollers 202, and the substrate WF is transferred by rotation of the transfer rollers 202. The mounting positions of the transfer rollers 202 on the roller shafts 204 can be appropriately set as long as the substrate WF can be stably transferred at the positions. However, since the transfer rollers 202 come into contact with the substrate WF, they should be arranged such that the transfer rollers 202 come into contact with the area where no problem occurs even when coming into contact with the substrate WF to be processed. In the one embodiment, the transfer rollers 202 of the loading unit 100 can be configured of a conductive polymer. In the one embodiment, the transfer rollers 202 are electrically grounded via the roller shafts 204 or the like. This avoids damage of the substrate WF due to being charged. Further, in the one embodiment, the loading unit 100 may be provided with an ionizer (not illustrated) to avoid charging of the substrate WF.

<Transfer Unit>

The substrate processing apparatus 1000 illustrated in FIG. 1 includes the two transfer units 200A and 200B. Since the two transfer units 200A and 200B can have the same configuration, they will be described collectively as the transfer unit 200 below.

The illustrated transfer unit 200 includes the plurality of transfer rollers 202 for transferring the substrate WF. By rotating the transfer rollers 202, the substrate WF on the transfer rollers 202 can be transferred in a predetermined direction. The transfer rollers 202 of the transfer unit 200 may be formed of a conductive polymer or may be formed of a non-conductive polymer. The transfer rollers 202 are driven by a motor (not illustrated). The substrate WF is transferred to a substrate grip-or-release position by the transfer rollers 202.

In the one embodiment, the transfer unit 200 includes cleaning nozzles 284. The cleaning nozzle 284 is connected to a supply source of a cleaning liquid (not illustrated). The cleaning nozzle 284 is configured to supply the cleaning liquid to the substrate WF transferred by the transfer rollers 202.

<Polishing Unit>

Figure 2:
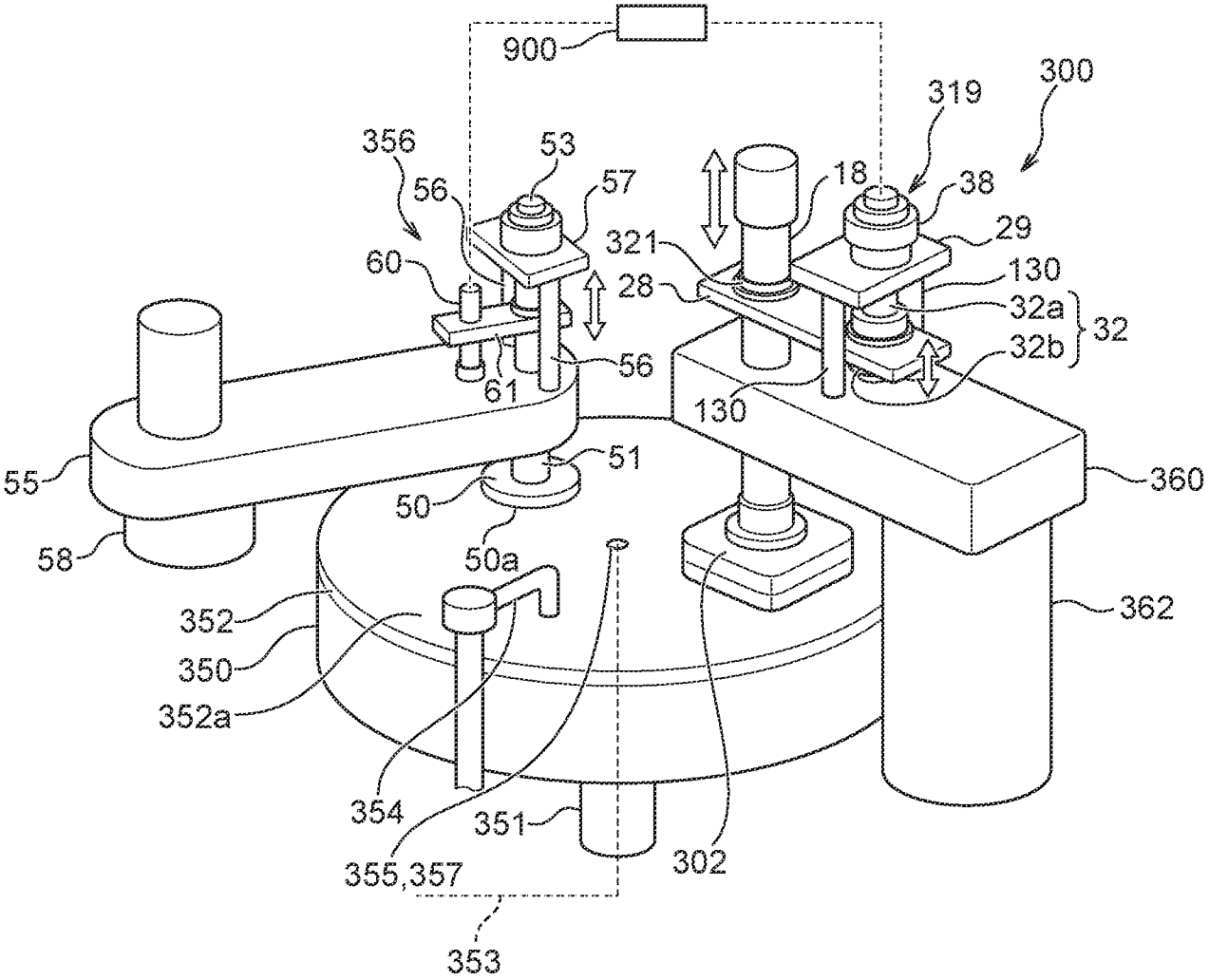
FIG. 2 is a perspective view schematically illustrating a configuration of a polishing unit according to the one embodiment.

FIG. 2 is a perspective view schematically illustrating a configuration of the polishing unit 300 according to the one embodiment. The substrate processing apparatus 1000 illustrated in FIG. 1 includes two polishing units 300A and 300B. Since the two polishing units 300A and 300B can have the same configuration, they will be described collectively as the polishing unit 300 below.

As illustrated in FIG. 2, the polishing unit 300 includes a polishing table 350 and a top ring 302 constituting a polishing head that holds and presses the substrate to be polished against a polishing surface on the polishing table 350. The polishing table 350 is coupled to a polishing table rotation motor (not illustrated), arranged below a table shaft 351, via the table shaft 351 and is rotatable around the table shaft 351. A polishing pad 352 is attached to an upper surface of the polishing table 350, and a surface 352*a* of the polishing pad 352 constitutes a polishing surface that polishes the substrate. In the one embodiment, the polishing pad 352 may be attached via a layer for facilitating peeling from the polishing table 350. Such a layer includes, for example, a silicone layer or a fluorine-based resin layer, and for example, those described in Japanese Unexamined Patent Application Publication No. 2014-176950 may be used.

A polishing liquid supply nozzle 354 is installed above the polishing table 350, and the polishing liquid is supplied onto the polishing pad 352 on the polishing table 350 by the polishing liquid supply nozzle 354. Further, as illustrated in FIG. 2, the polishing table 350 and the table shaft 351 are provided with a passage 353 for supplying the polishing liquid. The passage 353 communicates with an opening portion 355 on the surface of the polishing table 350. A through hole 357 is formed in the polishing pad 352 at the position corresponding to the opening portion 355 of the polishing table 350, and the polishing liquid passing through the passage 353 is supplied from the opening portion 355 of the polishing table 350 and the through hole 357 of the polishing pad 352 to the surface of the polishing pad 352. Note that the numbers of the opening portion 355 of the polishing table 350 and the through hole 357 of the polishing pad 352 may be one or plural. Further, although the position of the opening portion 355 of the polishing table 350 and the through hole 357 of the polishing pad 352 is appropriately set, in the one embodiment, they are arranged near the center of the polishing table 350.

Although not illustrated in FIG. 2, in the one embodiment, the polishing unit 300 includes an atomizer 358 for injecting a liquid or a mixed fluid of a liquid and a gas toward the polishing pad 352 (see FIG. 1). The liquid injected from the atomizer 358 is, for example, pure water, and the gas is, for example, nitrogen gas.

The top ring 302 is connected to a top ring shaft 18, and the top ring shaft 18 moves up and down with respect to a swing arm 360 by an up-and-down motion mechanism 319. The up-and-down motion of the top ring shaft 18 causes the entire top ring 302 to move up and down with respect to the swing arm 360 for positioning. The top ring shaft 18 rotates by driving a top ring rotation motor (not illustrated). The rotation of the top ring shaft 18 causes the top ring 302 to rotate about the top ring shaft 18.

The top ring 302 can hold a quadrangular substrate on its lower surface. The swing arm 360 is configured to be turnable around a spindle 362. The top ring 302 can move between the substrate grip-or-release position of the above-described transfer unit 200 and the upper side of the polishing table 350 by the turn of the swing arm 360. By moving the top ring shaft 18 down, the top ring 302 can be moved down to press the substrate against the surface (polishing surface) 352*a* of the polishing pad 352. At this time, the top ring 302 and the polishing table 350 are each rotated, and the polishing liquid is supplied from the polishing liquid supply nozzle 354 disposed above the polishing table 350 and/or from the opening portion 355 provided in the polishing table 350 onto the polishing pad 352. Thus, by pressing the substrate WF against the polishing surface 352*a* of the polishing pad 352, the surface of the substrate can be polished. During polishing of the substrate WF, the arm 360 may be fixed or swung such that the top ring 302 passes through the center of the polishing pad 352 (so as to cover the through hole 357 of the polishing pad 352).

The up-and-down motion mechanism 319, which moves the top ring shaft 18 and the top ring 302 up and down, includes a bridge 28 that rotatably supports the top ring shaft 18 via a bearing 321, a ball screw 32 mounted to the bridge 28, a support table 29 supported by a support column 130, and an AC servo motor 38 disposed on the support table 29. The support table 29 that supports the servo motor 38 is secured to the swing arm 360 via the support column 130.

The ball screw 32 includes a screw shaft 32*a* coupled to the servo motor 38 and a nut 32*b* into which the screw shaft 32*a* is screwed. The top ring shaft 18 moves up and down integrally with the bridge 28. Therefore, when the servo motor 38 is driven, the bridge 28 moves up and down via the ball screw 32, whereby the top ring shaft 18 and the top ring 302 move up and down.

The polishing unit 300 according to the one embodiment includes a dressing unit 356 that dresses the polishing surface 352*a* of the polishing pad 352. The dressing unit 356 includes a dresser 50 that is slidably in contact with the polishing surface 352*a*, a dresser shaft 51 to which the dresser 50 is coupled, an air cylinder 53 disposed at an upper end of the dresser shaft 51, and a swing arm 55 that rotatably supports the dresser shaft 51. A lower portion of the dresser 50 is constituted by a dressing member 50*a*, and needle-shaped diamond particles are attached to a lower surface of the dressing member 50*a*. The air cylinder 53 is arranged on a support table 57 supported by support columns 56, and these support columns 56 are secured to the swing arm 55.

The swing arm 55 is configured to be driven by a motor (not illustrated) and turn around a spindle 58. The dresser shaft 51 rotates by driving of a motor (not illustrated), and the rotation of the dresser shaft 51 causes the dresser 50 to rotate around the dresser shaft 51. The air cylinder 53 moves the dresser 50 up and down via the dresser shaft 51 and presses the dresser 50 against the polishing surface 352*a* of the polishing pad 352 with a predetermined pressing force.

Dressing of the polishing surface 352*a* of the polishing pad 352 is performed in the following manner. The dresser 50 is pressed against the polishing surface 352*a* by the air cylinder 53, and at the same time, pure water is supplied to the polishing surface 352*a* from a pure water supply nozzle (not illustrated). In this state, the dresser 50 rotates around the dresser shaft 51, and the lower surface (diamond particles) of the dressing member 50*a* is brought into sliding contact with the polishing surface 352*a*. Thus, the dresser 50 scrapes off the polishing pad 352 and dresses the polishing surface 352*a*.

<Drying Unit>

The drying unit 500 is a device for drying the substrate WF. In the substrate processing apparatus 1000 illustrated in FIG. 1, the drying unit 500 dries the substrate WF which is cleaned by a cleaner of the transfer unit 200 after being polished by the polishing unit 300. As illustrated in FIG. 1, the drying unit 500 is arranged downstream of the transfer unit 200. The drying unit 500 includes nozzles 530 for injecting gas toward the substrate WF being transferred on the transfer rollers 202. The gas can be, for example, compressed air or nitrogen. The substrate WF can be dried by blowing off water droplets on the transferred substrate WF with the drying unit 500.

<Unloading Unit>

The unloading unit 600 is a unit for unloading the substrate WF after processing, such as polishing and cleaning, is performed to outside of the substrate processing apparatus 1000. In the substrate processing apparatus 1000 illustrated in FIG. 1, the unloading unit 600 receives the substrate after being dried by the drying unit 500. As illustrated in FIG. 1, the unloading unit 600 is arranged downstream of the drying unit 500. In the one embodiment, the unloading unit 600 is configured to comply with Mechanical Equipment Interface Standard (IPC-SMEMA-9851) of Surface Mount Equipment Manufacturers Association (SMEMA).

<Top Ring>

Figure 3A:
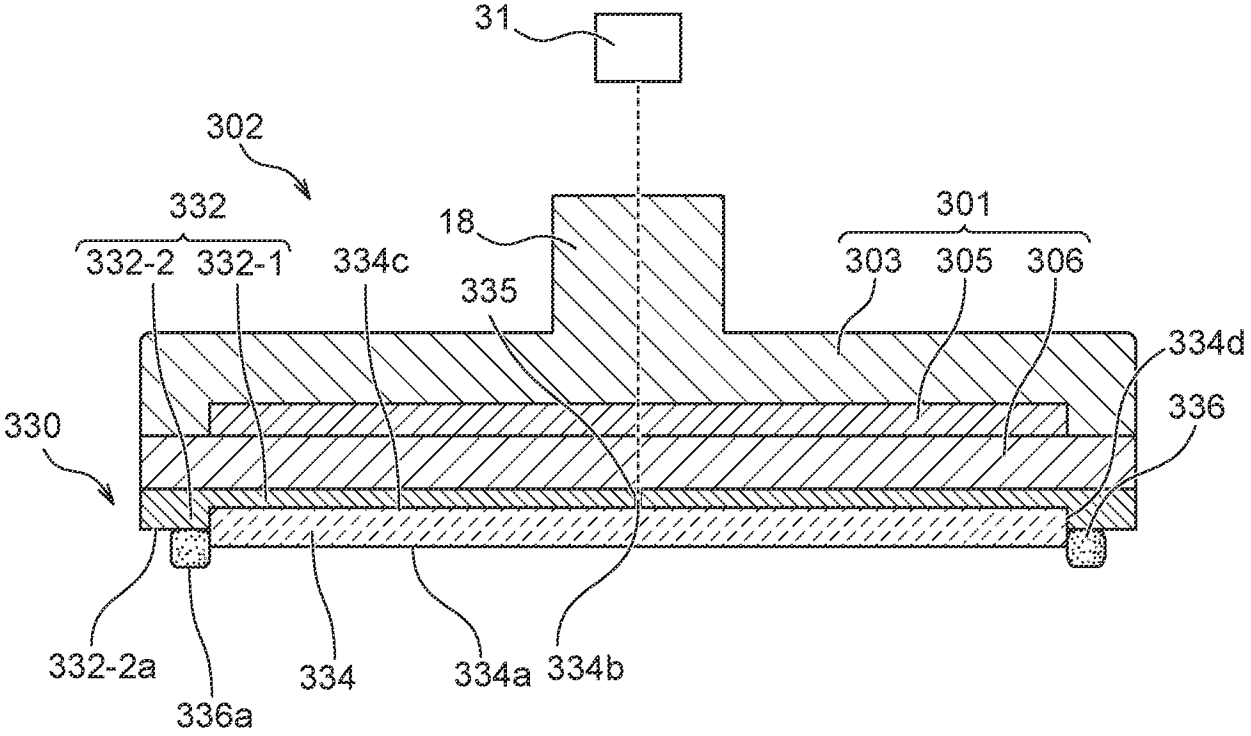
FIG. 3A is a cross-sectional view schematically illustrating a top ring of the one embodiment.
Figure 3B:
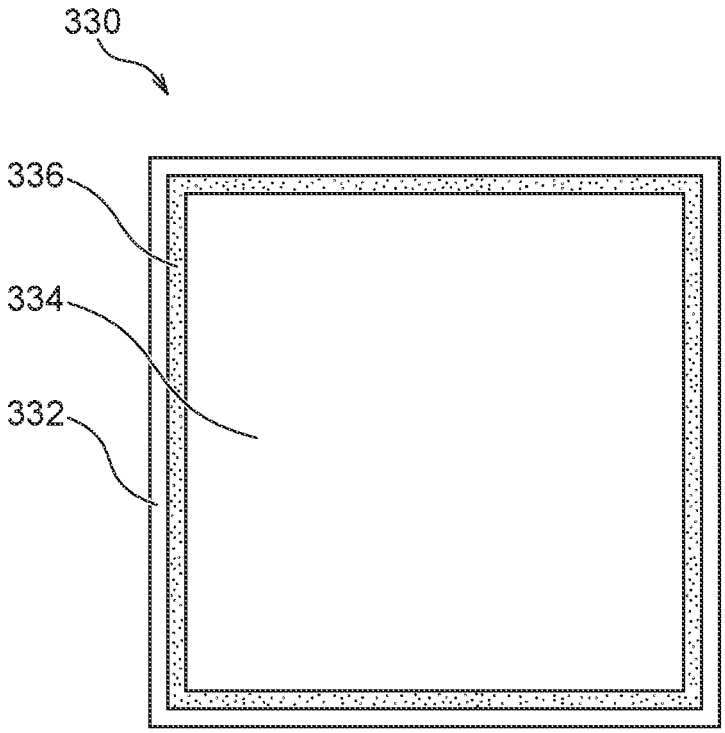
FIG. 3B is a plan view schematically illustrating the top ring of the one embodiment.

Next, the top ring 302 in the polishing unit 300 according to the one embodiment will be described. FIG. 3A is a cross-sectional view schematically illustrating a top ring of the one embodiment. FIG. 3B is a plan view schematically illustrating the top ring of the one embodiment. As illustrated in FIG. 3A and FIG. 3B, the top ring 302 includes the top ring shaft (rotation shaft) 18 and a base member 301 coupled to the top ring shaft 18. The base member 301 specifically includes a flange 303 coupled to the top ring shaft 18, a plate-shaped spacer 305 disposed at a rectangular recess formed in the center of the lower surface of the flange 303, and a plate-shaped carrier 306 disposed at a lower portion of the flange 303 and the spacer 305.

The top ring 302 includes a substrate suction member 330 for suctioning a back surface of the substrate WF having a surface to be polished facing downward. The substrate suction member 330 is attached to the lower surface of the carrier 306. The substrate suction member 330 includes a porous member 334. It is only necessary that the porous member 334 is a member that can perform vacuum suction of the substrate WF by vacuum drawing using pressure reducing means (vacuum source) 31, and the porous member 334 can be configured of, for example, a resin porous material in which a resin is provided with multiple pores, such as polyethylene (PE), polypropylene (PP), polytetrafluoroethylene (PTFE), or polyvinyl chloride (PVC). The porous member 334 is formed in a plate shape in this embodiment and includes a substrate suction surface 334*a* for suctioning the substrate WF and a pressure reducer 334*b* communicating with the pressure reducing means (vacuum source) 31.

The substrate suction member 330 includes a shielding member 332. It is only necessary that the shielding member 332 is an airtight member that can shield the flow of gas, and can be formed of, for example, a relatively soft resin plate, such as polyethylene (PE), polypropylene (PP), polytetrafluoroethylene (PTFE), or polyvinyl chloride (PVC). In this embodiment, the shielding member 332 includes a plate-shaped first shielding member 332-1 that shields a surface 334*c* in the opposite side of the substrate suction surface 334*a* of the porous member 334, and a second shielding member 332-2 provided at a peripheral edge portion of a lower surface of the first shielding member 332-1. In this embodiment, the second shielding member 332-2 is a frame-shaped member that shields a part of a side surface 334*d* of the porous member 334. However, not limited to this, the second shielding member 332-2 may be a frame-shaped member that shields the entire side surface 334*d* of the porous member 334. The first shielding member 332-1 and the second shielding member 332-2 are formed as an integrated member. The first shielding member 332-1 is provided with a vacuum hole 335 formed to communicate with the porous member 334. The pressure reducer 334*b* is provided at a position corresponding to the vacuum hole 335 of the surface 334*c* in the opposite side of the substrate suction surface 334*a* of the porous member 334.

In the top ring 302 that suctions to hold the substrate WF on the porous member 334 like this embodiment, it is required to reliably suction the substrate WF regardless of the flatness of the surface to be suctioned of the substrate WF. That is, when the surface to be suctioned of the substrate WF is flat, the substrate WF can be easily suctioned to the porous member 334 by vacuum suction. However, when the surface to be suctioned is not flat, for example, a part of an outer peripheral portion of the surface to be suctioned of the substrate WF is depressed, air leakage from a gap generated by depression decreases the suction force, resulting in failure in suctioning the substrate WF to the porous member 334 in some cases.

Therefore, the substrate suction member 330 of this embodiment includes, as illustrated in FIG. 3A and FIG. 3B, a frame-shaped elastic seal member 336 attached to a lower surface of the second shielding member 332-2 so as to surround the porous member 334. The elastic seal member 336 can be attached to the lower surface of the second shielding member 332-2 using any means, for example, an adhesive double coated tape. The elastic seal member 336 only needs to be a member having elasticity and capable of shielding a gas flow. For example, for the elastic seal member 336, a soft material having chemical resistance, satisfactory stretchability, and a skin surface can be used. That is, a common soft material is insufficient as a seal member because countless pores are provided at a surface and gas passes through. In view of this, for the elastic seal member 336, for example, an extrusion foaming material can be used. This makes the surface of the elastic seal member 336 a skin surface, allows shielding the gas flow, and provides the satisfactory stretchability. The elastic seal member 336 includes a contact surface 336*a* brought in contact with the substrate WF when the substrate WF is suctioned. The contact surface 336*a* projects beyond the substrate suction surface 334*a* of the porous member 334 in a state where the substrate WF is not in contact as illustrated in FIG. 3A. A silicone sponge is most preferable as a material of the elastic seal member 336, and a silicone rubber is also preferable. Soft Norseal made of polyvinyl chloride is also applicable.

Figure 4:
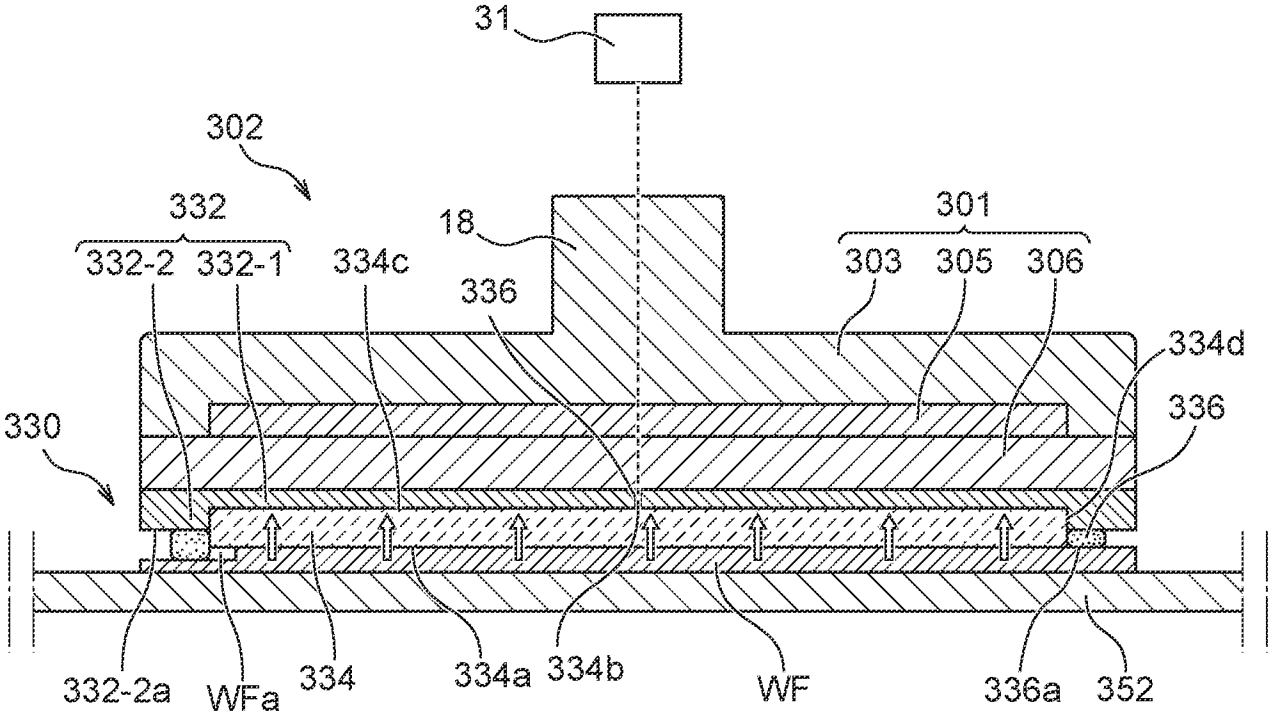
FIG. 4 is a cross-sectional view schematically illustrating the top ring and a substrate of the one embodiment.

FIG. 4 is a cross-sectional view schematically illustrating the top ring and the substrate of the one embodiment. FIG. 4 illustrates a state where the top ring, on which the substrate is held by grip-or-release means (not illustrated) at the above-described substrate grip-or-release position (not illustrated), is located at a polishing position of the polishing pad 352 on the polishing table 350. As illustrated in FIG. 4, when the substrate suction member 330 suctions the substrate WF, the substrate WF contacts the contact surface 336*a* of the elastic seal member 336. Here, since the elastic seal member 336 has the satisfactory stretchability, the elastic seal member 336 is pressed against the substrate WF and contracts when the substrate WF is suctioned, thus sealing between an atmosphere around the top ring 302 and the porous member 334. The elastic seal member 336 is restored in the original shape when the suction of the substrate WF is released and the substrate WF separates.

According to this embodiment, for example, as illustrated in FIG. 4, even when the outer peripheral portion of the surface to be suctioned of the substrate WF is partially depressed and a step WFa is formed, since the elastic seal member 336 is provided, air leakage from a gap generated by the step WFa can be avoided. Therefore, according to this embodiment, the substrate WF can be reliably suctioned to the substrate suction member 330 regardless of the flatness of the surface to be suctioned of the substrate WF.

Further, according to this embodiment, when the porous member 334 is vacuum drawn by the pressure reducing means (vacuum source) 31, since the air leakage from the gap generated by the step WFa can be avoided, a negative pressure can be efficiently generated at the substrate suction surface 334*a*. Accordingly, since the substrate WF can be reliably suctioned to the substrate suction member 330, the substrate WF coming off outside (slipping out) during polishing can be avoided without providing a retainer member around the substrate WF. Especially, with the thinning of the substrate WF in recent years, even when a retainer member is provided, the substrate WF possibly slips out during polishing. When the substrate WF has a polygonal shape, a corner portion of the substrate WF contacts the retainer member during polishing, thus possibly damaging the substrate WF or the top ring. In contrast, according to this embodiment, since the substrate WF can be pressed against the polishing pad 352 while performing the vacuum suction of the substrate WF by the substrate suction member 330, the slip out of the substrate WF during polishing can be avoided, and damaging the substrate WF or the top ring during polishing can be avoided.

While the case where the outer peripheral portion of the surface to be suctioned of the substrate WF is partially depressed is described as an example in FIG. 4, it is not limited to this, according to this embodiment, the substrate WF can be reliably suctioned to the substrate suction member 330 also in the case where the surface to be suctioned of the substrate WF is flat. That is, in this embodiment, the second shielding member 332-2 is configured such that the substrate suction surface 334*a* of the porous member 334 projects beyond the attaching surface 332-2*a* of the second shielding member 332-2 for attaching the elastic seal member 336 to the second shielding member 332-2. In other words, the attaching surface 332-2*a* of the second shielding member 332-2 for attaching the elastic seal member 336 to the second shielding member 332-2 is depressed with respect to the substrate suction surface 334*a* of the porous member 334. The elastic seal member 336 is disposed to surround the side surface of the porous member 334 projecting beyond the attaching surface 332-2*a* of the second shielding member 332-2. Therefore, when the substrate WF having a flat surface to be suctioned is suctioned, since the contact surface 336*a* of the elastic seal member 336 pressed to be contracted by the substrate WF becomes the same plane with the substrate suction surface 334*a* of the porous member 334, the substrate WF can be reliably suctioned to the substrate suction member 330.

When the elastic seal member 336 brought in contact with the substrate WF is employed as described in this embodiment, it is possible that the substrate WF does not separate from the elastic seal member 336 even when the suction of the substrate WF is released. In this respect, since the elastic seal member 336 has a skin surface, the substrate WF is easily released when the suction of the substrate WF is released. In addition, on the contact surface 336*a* of the elastic seal member 336, to avoid naturally adhering to be secured to the substrate WF (not to cause a blooming phenomenon), coating, such as fluororesin coating, for example, Teflon (registered trademark) processing using polytetrafluoroethylene as a material, may be performed. The contact surface 336*a* of the elastic seal member 336 may be coated by impregnation.

According to this embodiment, providing the elastic seal member 336 enables sealing between the atmosphere around the top ring 302 and the porous member 334. Therefore, the polishing liquid flowing to the substrate suction surface 334*a* of the porous member 334 can be avoided. Consequently, it can be avoided that abrasive grains contained in the polishing liquid clog the pores of the porous member 334, thus reducing suction performance of the substrate suction member 330 and adversely affecting the product lifetime of the substrate suction member 330.

Figure 5:
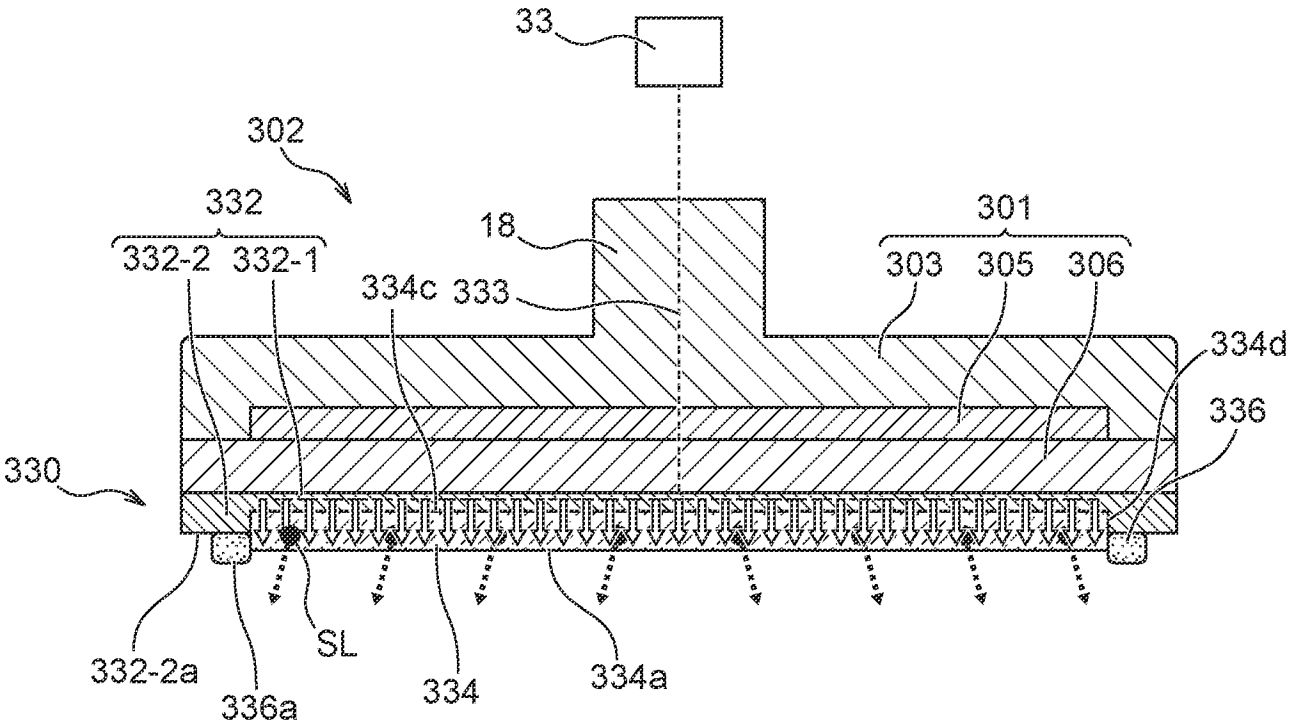
FIG. 5 is a cross-sectional view schematically illustrating the top ring of the one embodiment.

Furthermore, the top ring 302 of this embodiment includes means to deal with a case where the abrasive grains enter the pores of the porous member 334. FIG. 5 is a cross-sectional view schematically illustrating the top ring of the one embodiment. As illustrated in FIG. 5, the top ring 302 includes an abrasive grain cleaning member 33. The abrasive grain cleaning member 33 is configured to supply a fluid, such as air or pure water, to the surface 334*c* in the opposite side of the substrate suction surface 334*a* of the porous member 334 via a flow passage 333 formed at the base member 301 and the shielding member 332. By supplying the fluid to the surface 334*c* in the opposite side of the substrate suction surface 334*a* of the porous member 334, abrasive grains SL clogging the pores of the porous member 334 can be washed away. The step of cleaning the porous member 334 may be performed after the polishing step simultaneously with a step of releasing the suction of the substrate WF at the substrate grip-or-release position (not illustrated) and releasing the substrate WF from the top ring 302 by the grip-or-release means (not illustrated).

Figure 6:
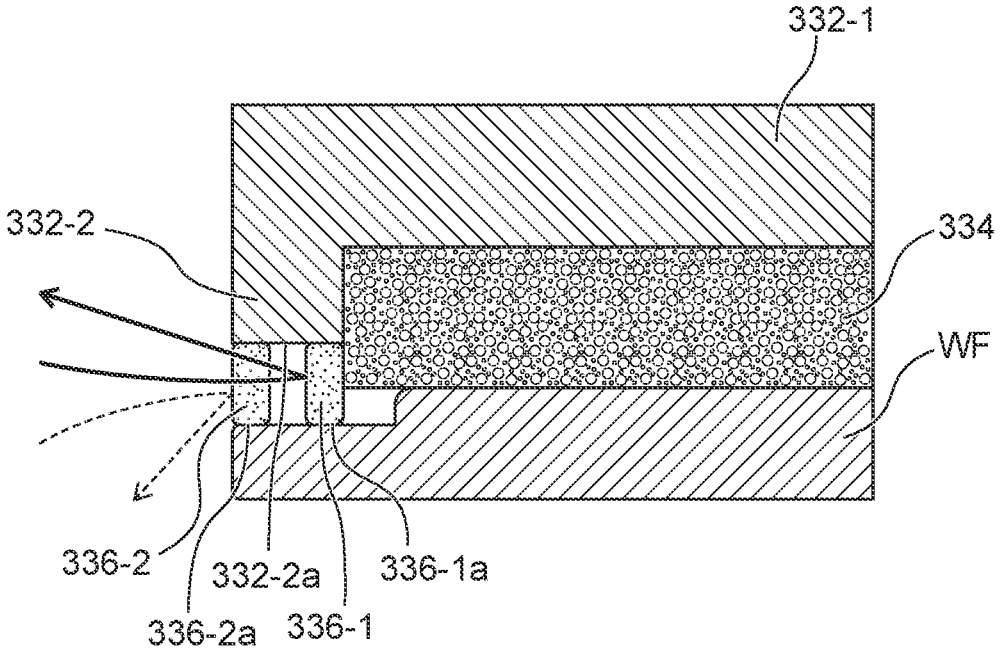
FIG. 6 is a cross-sectional view of schematically illustrating a partially enlarged top ring of one embodiment.

Next, a modification of the top ring 302 will be described. FIG. 6 is a cross-sectional view schematically illustrating a partially enlarged top ring of one embodiment. Since the configurations other than the substrate suction member 330 are similar to those in the embodiment of FIG. 3 to FIG. 5, the description will be omitted. As illustrated in FIG. 6, the elastic seal member 336 can be configured to include a first elastic seal member 336-1 that surrounds the side surface of the porous member 334 projecting beyond the attaching surface 332-2*a* of the second shielding member 332-2, and a second elastic seal member 336-2 provided at an outside of the first elastic seal member 336-1 with an interval.

The first elastic seal member 336-1 only needs to be a member that can shield the gas flow, and includes a contact surface 336-1*a* brought in contact with the substrate WF. The second elastic seal member 336-2 only needs to be a member that can shield the flow of the polishing liquid, and includes a contact surface 336-2*a* brought in contact with the substrate WF. According to this embodiment, the inflow of the polishing liquid and the inflow of the gas to the porous member 334 can be sealed with more certainty. As a result, since the air leakage to the porous member 334 can be avoided, and clogging of the pores of the porous member 334 with the abrasive grains can be avoided, the substrate WF can be reliably suctioned to the substrate suction member 330.

Figure 7:
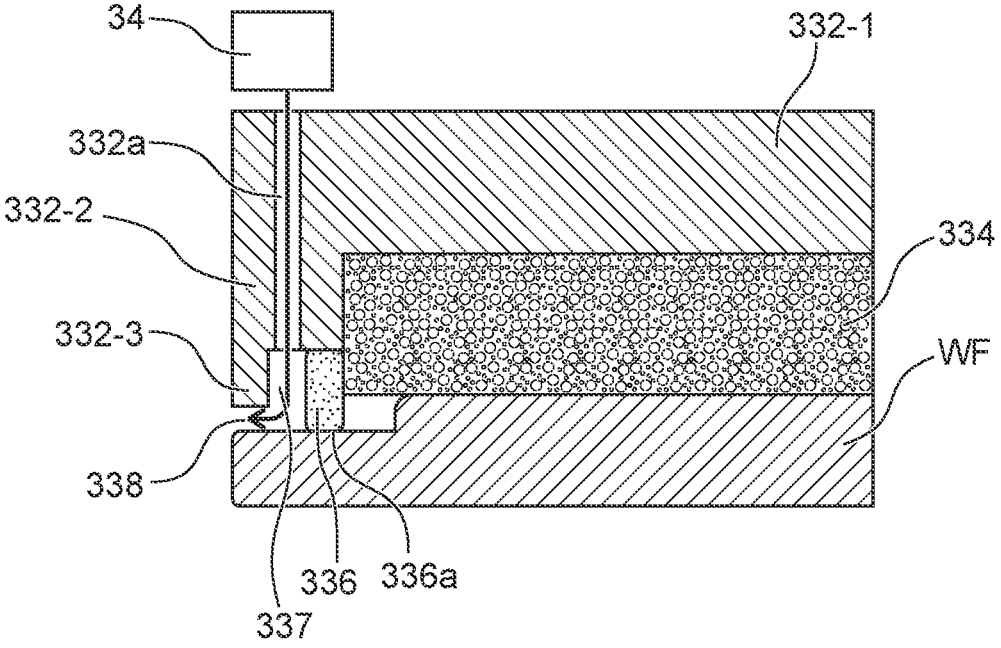
FIG. 7 is a cross-sectional view schematically illustrating a partially enlarged top ring of one embodiment.

Next, another modification of the top ring 302 will be described. FIG. 7 is a cross-sectional view schematically illustrating a partially enlarged top ring of one embodiment. As illustrated in FIG. 7, the shielding member 332 further includes a frame-shaped third shielding member 332-3 provided at a lower portion outer peripheral side of the second shielding member 332-2. The third shielding member 332-3 is provided at an outside of the elastic seal member 336 with an interval. The third shielding member 332-3 is configured to be provided with a clearance 338 between a lower surface of the third shielding member 332-3 and the substrate WF. The first shielding member 332-1 and the second shielding member 332-2 are provided with a fluid flow passage 332*a* to discharge the fluid to a space 337 between the elastic seal member 336 and the third shielding member 332-3. The top ring 302 includes a fluid supply member 34 configured to supply the fluid (for example, air) to the space 337 via the fluid flow passage 332*a*.

The fluid supplied from the fluid supply member 34 to the space 337 via the fluid flow passage 332*a* is squirted outside from the clearance 338 between the lower surface of the third shielding member 332-3 and the substrate WF. This allows suppressing the flowing in of air and the polishing liquid to the porous member 334 from outside of the top ring 302. As a result, since the air leakage to the porous member 334 can be avoided, and clogging of the pores of the porous member 334 with the abrasive grains can be avoided, the substrate WF can be reliably suctioned to the substrate suction member 330.

Figure 8:
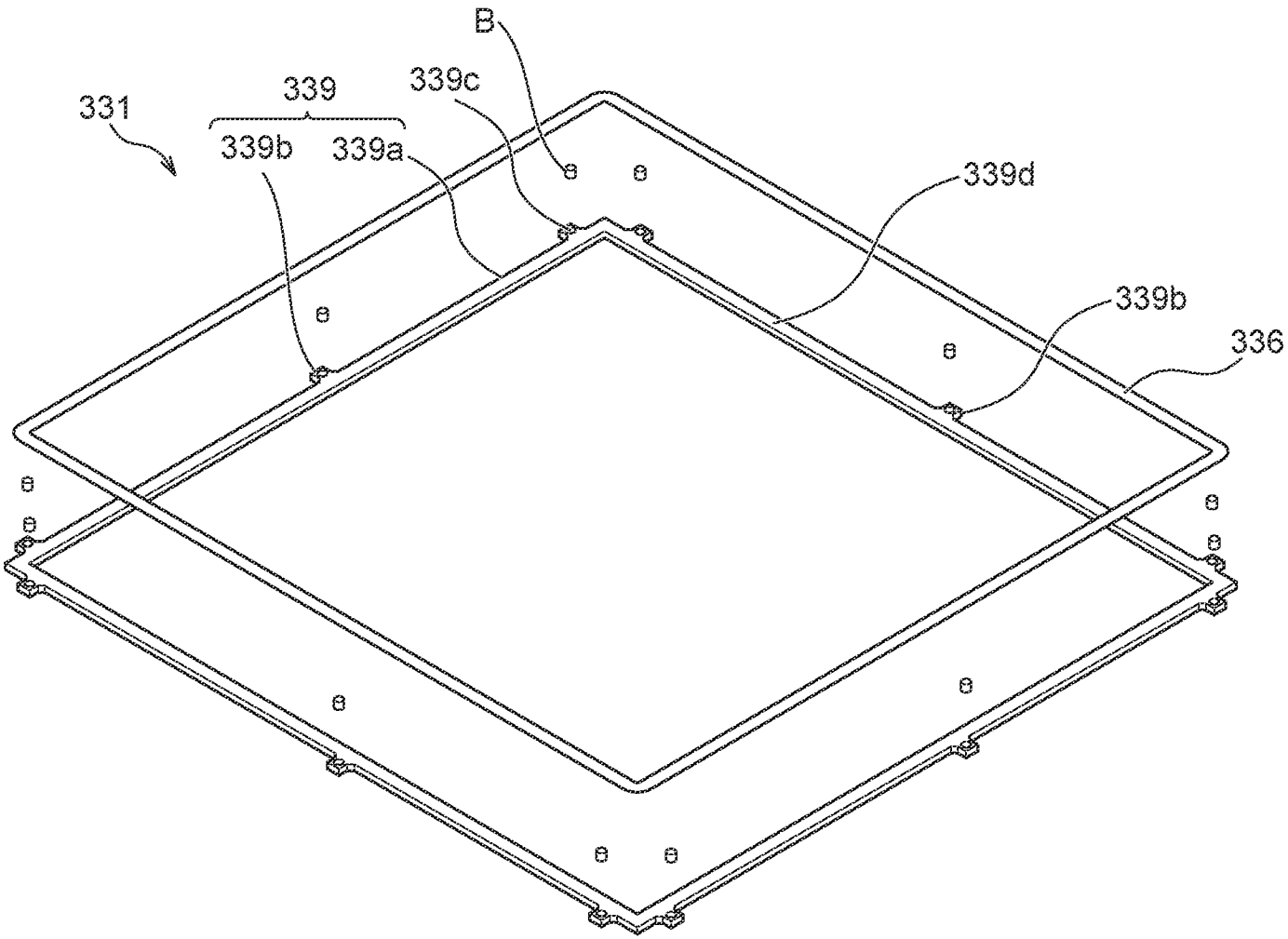
FIG. 8 is a perspective view schematically illustrating a configuration of an elastic seal assembly of one embodiment.
Figure 9:
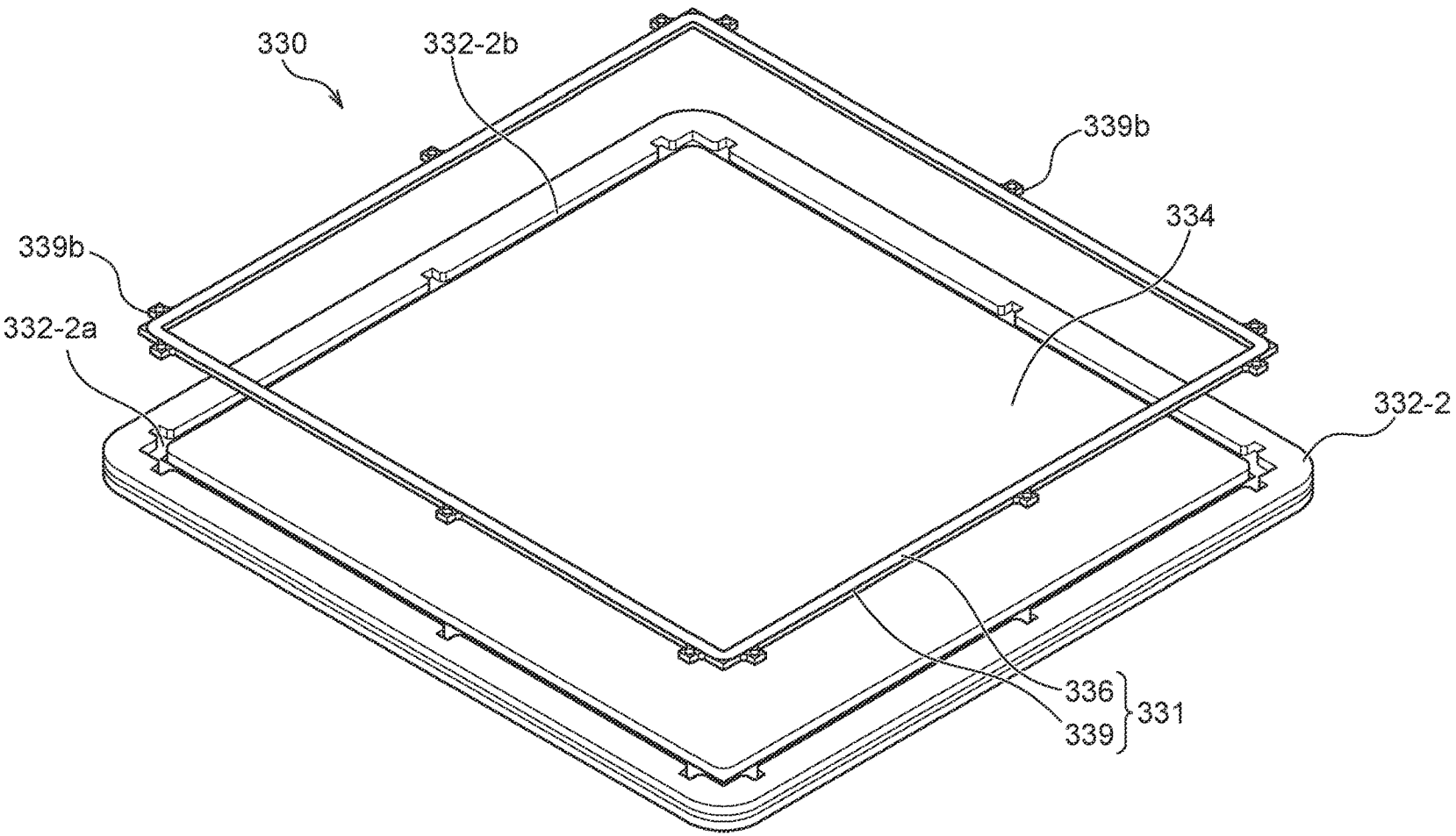
FIG. 9 is a perspective view schematically illustrating a configuration of a substrate suction member including the elastic seal assembly of the one embodiment.

Next, an elastic seal assembly of this embodiment will be described. While the above embodiment indicates an example in which the elastic seal member 336 is attached to the second shielding member 332-2 using means, such as an adhesive double coated tape, it is not limited to this, an elastic seal assembly can be attached to the second shielding member 332-2. FIG. 8 is a perspective view schematically illustrating a configuration of an elastic seal assembly of one embodiment. FIG. 9 is a perspective view schematically illustrating a configuration of a substrate suction member including the elastic seal assembly of the one embodiment.

FIG. 8 and FIG. 9 are perspective views of the elastic seal assembly and the substrate suction member viewed from the back side. As illustrated in FIG. 8 and FIG. 9, the elastic seal assembly 331 includes a frame-shaped fixing frame 339. The fixing frame 339 is a member having a rigidity, and is formed to be attached to the second shielding member 332-2 so as to surround the porous member 334. Specifically, the fixing frame 339 is configured to include a rectangular frame 339*a* configured to surround the side surface 334*d* of the porous member 334, and a plurality of (in this embodiment, 12) protrusions 339*b* projecting outward from the frame 339*a*. The protrusion 339*b* is provided with a bolt hole 339*c* for attaching the elastic seal assembly 331 to the second shielding member 332-2 with a bolt B. The elastic seal assembly 331 includes an elastic seal member 336 attached to the fixing frame 339. Since the elastic seal member 336 has a configuration similar to that described in the above embodiment, the detailed description will be omitted. The elastic seal member 336 is attached to a surface 339*d* of the fixing frame 339 in the opposite side of a fixing surface attached to the second shielding member 332-2 with any means, such as an adhesive or an adhesive double coated tape. In the embodiment of FIG. 9, a groove 332-2*b* having a shape corresponding to the elastic seal assembly 331

(fixing frame 339) is provided at a bottom surface of the second shielding member 332-2, and an attaching surface 332-2*a* is formed at a bottom surface of the groove 332-2*b*. The elastic seal assembly 331 is fitted to the groove 332-2*b*, and secured to the second shielding member 332-2 using the bolts B.

According to this embodiment, for example, when the elastic seal member 336 reaches the end of the product lifetime due to wear and the like, the elastic seal member 336, which is a consumable part, can be easily replaced. That is, in the case where the elastic seal member 336 is directly attached to the second shielding member 332-2 using the adhesive double coated tape or the like as described in the above embodiment, the attachment is difficult because the positioning is not easy due to bending of the elastic seal member 336 having elasticity. Especially, at a site on which the substrate processing apparatus 1000 is installed, since a jig or the like for attachment is not prepared, and a worker with installation skills is often not present, replacement of the elastic seal member 336 is not easy. In contrast, according to this embodiment, for example, in a manufacturing plant of the elastic seal assembly 331, the elastic seal assembly 331 is manufactured using a dedicated jig or by a worker with installation skills, and delivered to the installation site of the substrate processing apparatus 1000. Since the elastic seal assembly 331 includes the elastic seal member 336 already attached to the fixing frame 339 having rigidity, at the installation site of the substrate processing apparatus 1000, a general worker can easily attach the elastic seal assembly 331 to the second shielding member 332-2 using bolts.

While this embodiment indicates an example in which bolts are used to fix the elastic seal assembly 331 to the second shielding member 332-2, any fixing method can be employed. For example, magnets are embedded to the frame 339*a* and the second shielding member 332-2, and the second shielding member 332-2 can be fixed to the frame 339*a* by magnetic force. In this case, the protrusion 339*b* does not need to be provided.

Figure 10:
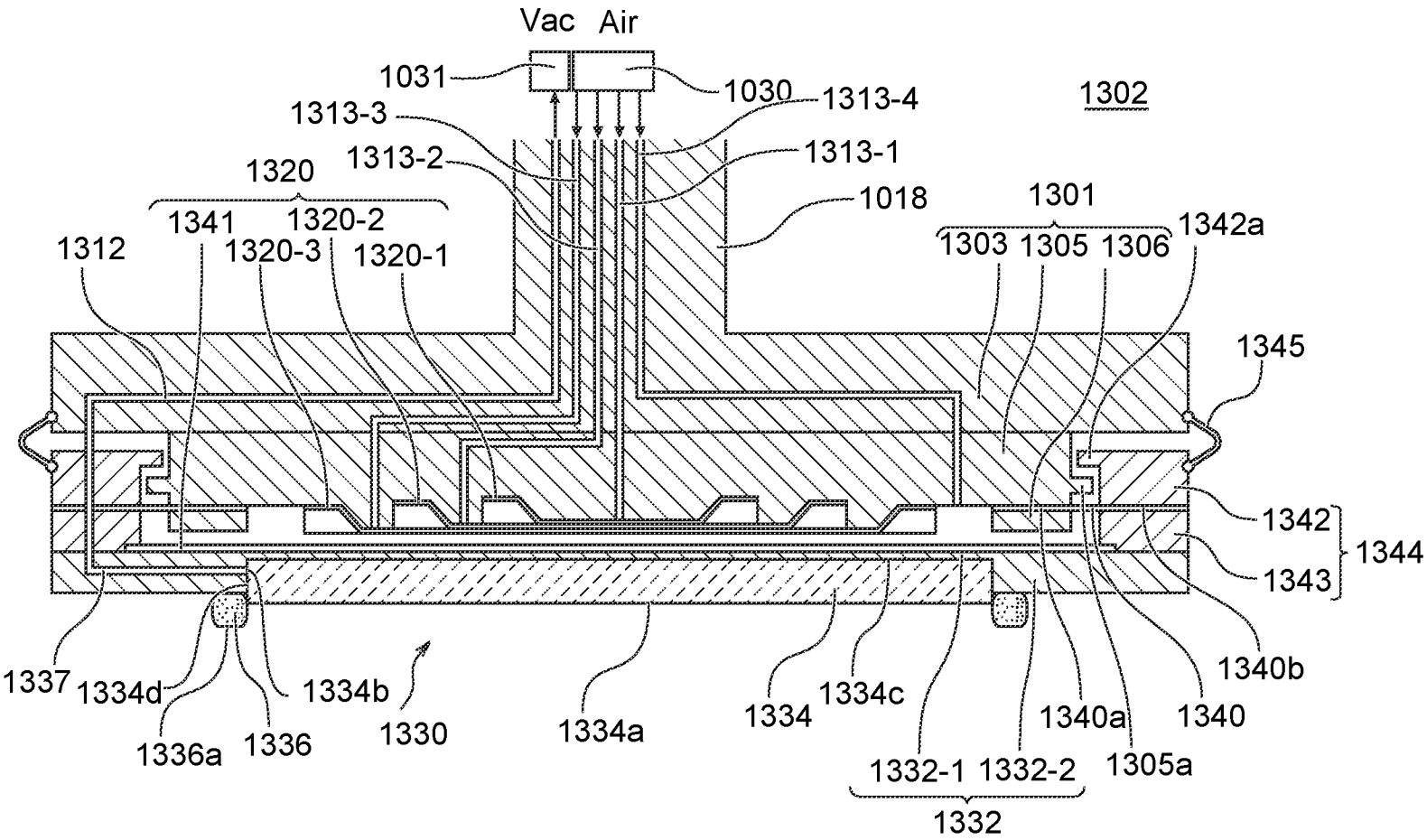
FIG. 10 is a cross-sectional view schematically illustrating a top ring of one embodiment.

Next, another embodiment of the top ring will be described. FIG. 10 is a cross-sectional view schematically illustrating a top ring of one embodiment. As illustrated in FIG. 10, a top ring 1302 includes a base member 1301 coupled to a top ring shaft (rotation shaft) 1018. The base member 1301 specifically includes a flange 1303 coupled to the top ring shaft 1018, an upper guide member 1305 disposed at the lower side of the flange 1303, and a lower guide member 1306 disposed at a lower side of the upper guide member 1305. The upper guide member 1305 has a plane size smaller than a plane size of the flange 1303, and projects downward from the lower surface of the flange 1303. The lower guide member 1306 having a frame shape is disposed at a peripheral edge portion of the lower surface of the upper guide member 1305. The plane size of the upper guide member 1305 or the flange 1303 means a size of the upper guide member 1305 or the flange 1303 when the upper guide member 1305 or the flange 1303 is viewed in plan view (viewed in a direction along the top ring shaft 1018).

The top ring 1302 includes a substrate suction member 1330 for suctioning a back surface of the substrate WF having a surface to be polished facing downward. The substrate suction member 1330 is located below the base member 1301. The substrate suction member 1330 includes a porous member 1334. The porous member 1334 is configured of a material similar to that of the porous member 334 of the above-described embodiment. The porous member 1334 includes a substrate suction surface 1334*a* for suctioning the substrate WF and a pressure reducer 1334*b* communicated with pressure reducing means (vacuum source) 1031.

The substrate suction member 1330 includes a shielding member 1332. The shielding member 1332 is configured of a material similar to that of the shielding member 332 of the above-described embodiment. The shielding member 1332 includes a plate-shaped first shielding member 1332-1 that shields a surface 1334*c* in the opposite side of the substrate suction surface 1334*a* of the porous member 1334, and a second shielding member 1332-2 provided at a peripheral edge portion of a lower surface of the first shielding member 1332-1. The shielding member 1332 is formed to shield the surface 1334*c* in the opposite side of the substrate suction surface 1334*a* and a part of a side surface 1334*d* of the porous member 1334. The shielding member 1332 is provided with a vacuum hole 1337 formed to communicate with the porous member 1334. The pressure reducer 1334*b* is provided at a position at which the vacuum hole 1337 is formed. In this embodiment, the vacuum hole 1337 is formed at the shielding member 1332 to communicate with the side surface 1334*d* of the porous member 1334, and the pressure reducer 1334*b* is provided at the side surface 1334*d*. The vacuum hole 1337 has one end portion connected to the side surface 1334*d* of the porous member 1334, and the other end portion connected to the pressure reducing means 1031 via a suction passage 1312.

In this embodiment, the pressure reducer 1334*b* provided at the side surface 1334*d* of the porous member 1334 allows the substrate WF to have a uniform polishing profile. That is, the position at which the pressure reducer 1334*b* is provided locally becomes to have a negative pressure due to the vacuum drawing by the pressure reducing means 1031. Here, when the pressure reducer 1334*b* is provided at the surface 1334*c* in the opposite side of the substrate suction surface 1334*a* of the porous member 1334, the position locally becomes to have the negative pressure. Thus, the pressing force against the substrate WF becomes hard to act compared with another position, and consequently, the polishing profile possibly becomes uneven. In contrast, in this embodiment, since the pressure reducer 1334*b* is provided at the side surface 1334*d* of the porous member 1334, the local negative pressure is less likely to be caused at the surface 1334*c* in the opposite side of the substrate suction surface 1334*a* of the porous member 1334. Thus, the polishing profile of the substrate WF can be made uniform.

As illustrated in FIG. 10, the substrate suction member 1330 includes a frame member 1344 provided at the shielding member 1332 to surround a peripheral area of at least a part (specifically, the upper guide member 1305 and the lower guide member 1306) of the base member 1301. The frame member 1344 includes a frame-shaped lower frame member 1343 disposed at a peripheral edge portion of the upper surface of the shielding member 1332, and a frame-shaped upper frame member 1342 disposed above the lower frame member 1343. The lower frame member 1343 and the shielding member 1332 are coupled via a sealing material 1341. While the sealing material 1341 is formed in a film shape that covers the upper surface of the substrate suction member 1330 in this embodiment, it is not limited to this, and the sealing material 1341 may have a frame shape having only a peripheral edge portion for sealing the lower frame member 1343 and the shielding member 1332.

The upper frame member 1342 includes a frame member projection 1342*a* projecting in a direction of the base member 1301 (specifically, upper guide member 1305). The upper guide member 1305 includes a guide member projection 1305*a* projecting in a direction of the upper frame member 1342 at a height position different from the frame member projection 1342*a*. The frame member projection 1342*a* and the guide member projection 1305*a* overlap with one another in a predetermined region when the top ring 1302 is viewed in plan view. Accordingly, the contact of the frame member projection 1342*a* with the guide member projection 1305*a* allows restricting the move of the substrate suction member 1330 in the height direction.

The substrate suction member 1330 includes an elastic member 1340 that connects at least a part of the base member 1301 surrounded by the frame member 1344 to the frame member 1344. Specifically, the elastic member 1340 is a frame-shaped plate member having an inner end portion 1340*a* sandwiched between the upper guide member 1305 and the lower guide member 1306, and an outer end portion 1340*b* sandwiched between the lower frame member 1343 and the upper frame member 1342. While the elastic member 1340 can be formed of a rubber material, such as silicone rubber, ethylene-propylene-diene-monomer (EPDM) rubber, and fluorine-containing rubber (FKM), it is not limited to this.

As illustrated in FIG. 10, the top ring 1302 includes an elastic film 1320 configured to form a plurality of pressurization chambers for applying pressure to the substrate WF between the base member 1301 and the substrate suction member 1330. Specifically, the elastic film 1320 includes a film-shaped sealing material 1341, and a plurality of laminated elastic films 1320-1, 1320-2, 1320-3 that are different in area. Between the base member 1301 and the sealing material 1341, a pressurization chamber for applying pressure to the entire substrate WF is formed. The pressurization chamber is communicated with a pressure regulator 1030 via a pressure path 1313-4. The respective elastic films 1320-1, 1320-2, 1320-3 have center portions in contact with the upper surface of the shielding member 1332, and end portions extending from the center portion and being fixed to different positions of the lower surface of the upper guide member 1305. The plurality of elastic films 1320-1, 1320-2, 1320-3 concentrically form the plurality of pressurization chambers for applying pressure to the substrate WF between the base member 1301 and the plurality of elastic films 1320-1, 1320-2, 1320-3. The plurality of pressurization chambers are communicated with the pressure regulator 1030 via respective pressure paths 1313-1, 1313-2, 1313-3. The pressure regulator 1030 has a pressure regulation function of regulating the pressure of a pressurized fluid supplied to each pressurization chamber. That is, the pressure regulator 1030 regulates the pressure of the pressurized fluid supplied to the pressure path 1313-4, thereby enabling regulation of the pressure of the pressurization chamber for applying pressure to the entire substrate WF, and regulates the pressures of the pressurized fluid supplied to the pressure path 1313-1, 1313-2, 1313-3, thereby enabling regulation of the pressures of the plurality of concentric pressurization chambers. Thus, by forming a plurality of pressurization chambers, the pressing force of the substrate WF against the polishing pad 352 can be controlled for each area via the substrate suction member 1330. According to this embodiment, the pressure reducing means 1031 is used to make the porous member 1334 negative pressure, thereby enabling the suction of the substrate WF to the substrate suction surface 1334*a*, and the pressure regulator 1030 is used to apply pressure to the pressurization chamber, thereby enabling the pressing of the substrate WF against the polishing pad 352 via the substrate suction member 1330.

As illustrated in FIG. 10, the top ring 1302 further includes a band 1345 that connects an outer side surface of a part not surrounded by the frame member 1344 (specifically, flange 1303) of the base member 1301 to an outer side surface of the frame member 1344. The band 1345 is attached to from the outer side surface of the flange 1303 to the outer side surface of the upper frame member 1342. The band 1345 allows displacement of the substrate suction member 1330 to the base member 1301, and avoids entering of the polishing liquid and the like into a space between the substrate suction member 1330 and the base member 1301. As illustrated in FIG. 10, the top ring 1302 includes an elastic seal member 1336 similar to the elastic seal member 336 of the above-described embodiment. The elastic seal member 1336 may be attached to the second shielding member 1332-2 using an adhesive double coated tape or the like, and may be attached to the second shielding member 1332-2 in the form of the above-described elastic seal assembly 331.

According to this embodiment, even when the top ring 1302 or a polishing table 1350 to which the polishing pad 352 is attached inclines due to manufacturing tolerances and the like of respective components constituting the substrate processing apparatus 1000, the substrate WF can be uniformly pressed against the polishing pad 352. That is, according to this embodiment, the substrate suction member 1330 is not secured to the base member 1301, but held by the elastic member 1340. Therefore, provisionally, even when the top ring 1302 or the polishing table 1350 inclines to cause the substrate WF to be brought in partial contact with the polishing pad 352, the elasticity of the elastic member 1340 causes the substrate suction member 1330 to follow the polishing surface of the polishing pad 352, as a result, thereby enabling the substrate WF to be in contact with the polishing pad 352 in parallel. Accordingly, with this embodiment, the substrate WF can be uniformly pressed against the polishing pad 352.

In addition, according to this embodiment, a compact top ring can be achieved. That is, when the substrate suction member is supported to the base member via the elastic member, for example, it is considered that an opening is provided at the center of the lower surface of the base member, the substrate suction member is located in the opening, and a frame-shaped member of a peripheral edge portion forming the opening is connected to the substrate suction member using the elastic member. However, in such a configuration, when a suction passage for vacuum suction is routed from a porous member by passing through a frame-shaped member of the top ring, the plane size of the top ring increases due to a constraint of a space of the frame-shaped member, thus possibly hindering the top ring from being downsized.

In contrast, in the top ring 1302 of this embodiment, the substrate suction member 1330 includes the frame member 1344 surrounding at least a part of the base member 1301, and the frame member 1344 is connected to the base member 1301 by the elastic member 1340. Accordingly, even when the pressure reducer 1334*b* is disposed at the side surface 1334*d* of the porous member 1334, and the suction passage 1312 is routed by passing through the outer peripheral portion of the top ring 1302 as described in this embodiment, it is not necessary to increase the plane size of the frame member 1344, and consequently, the top ring 1302 can be compactly manufactured. The plane size of the top ring 1302 or the frame member 1344 means a size of the top ring 1302 or the frame member 1344 when the top ring 1302 or the frame member 1344 is viewed in plan view (viewed in a direction along the top ring shaft 1018).

Figure 11:
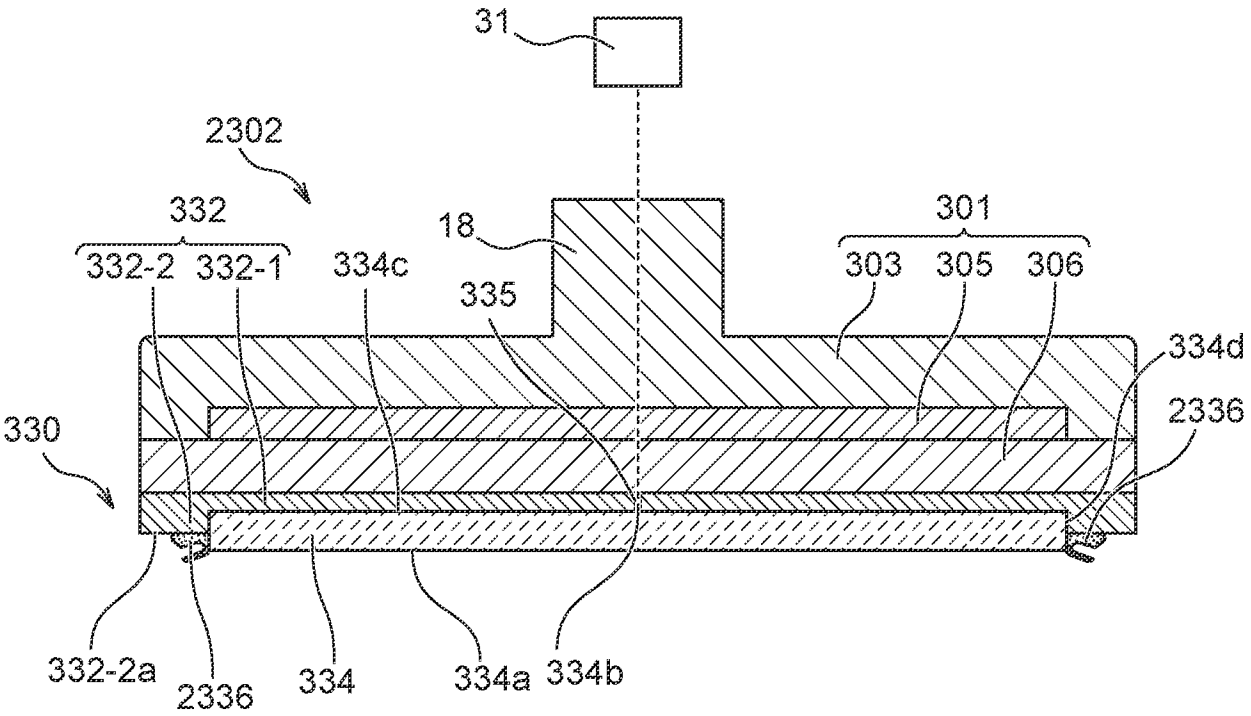
FIG. 11 is a cross-sectional view schematically illustrating a top ring of one embodiment.
Figure 12:
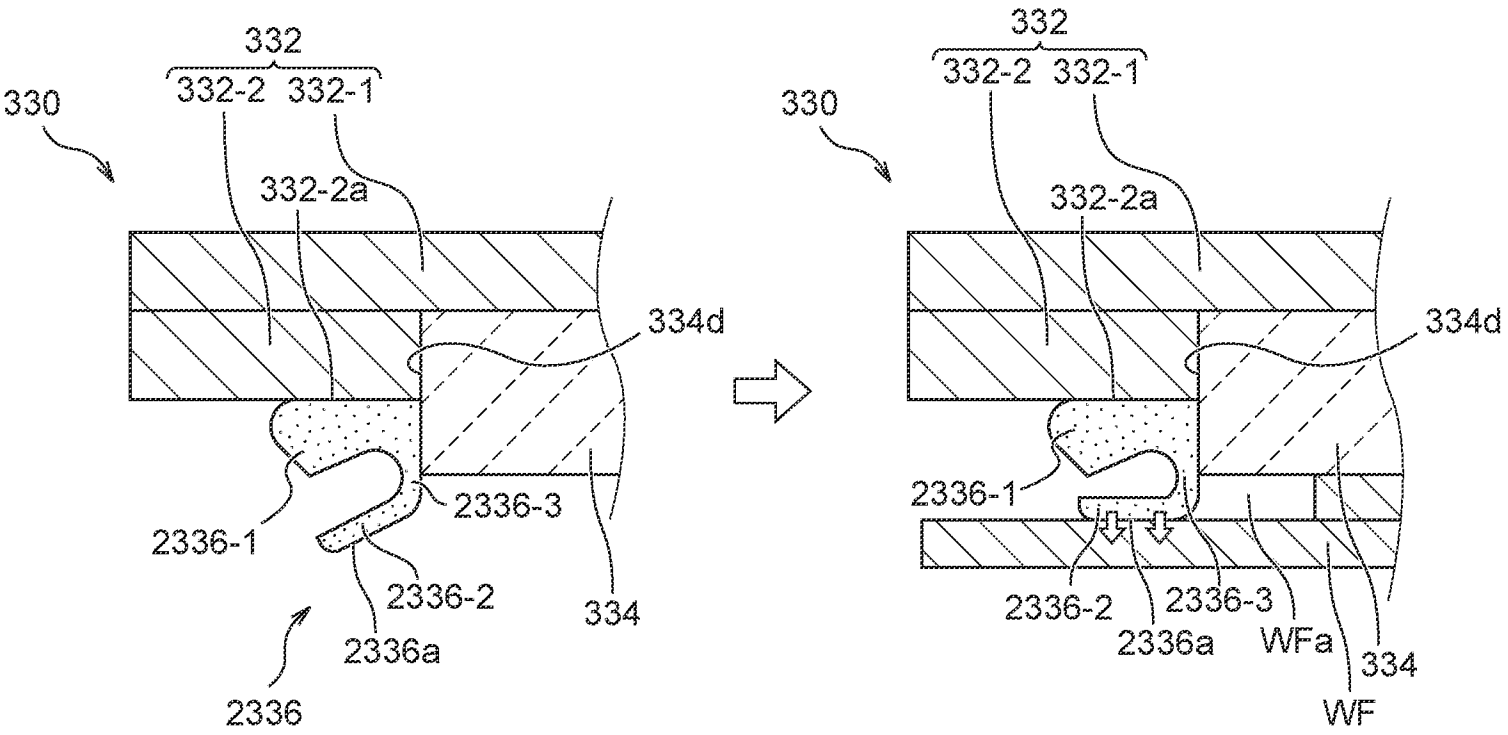
FIG. 12 is a cross-sectional view illustrating the partially enlarged top ring of the one embodiment.
Figure 13:
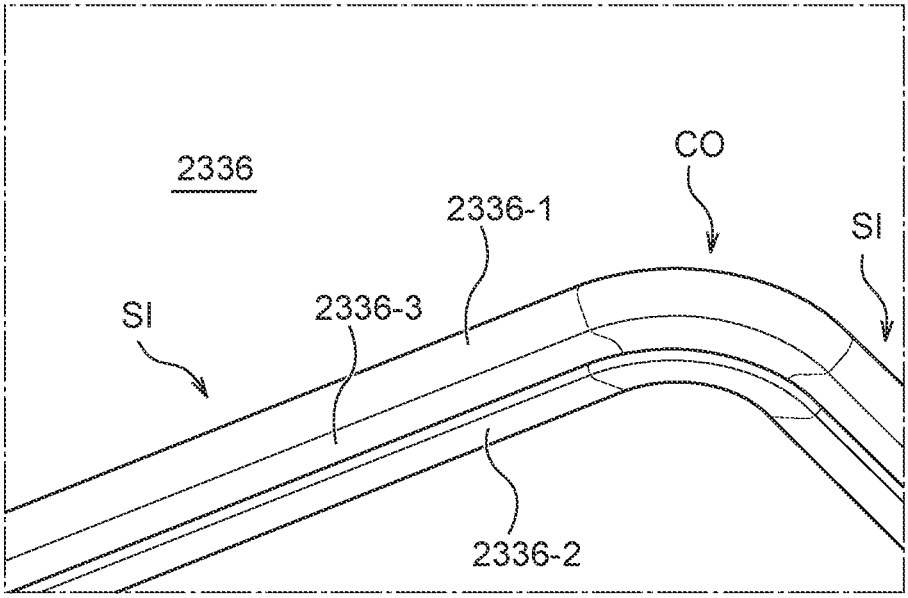
FIG. 13 is a perspective view illustrating a partially enlarged elastic seal member of the one embodiment.

Next, a modification of the top ring will be described. FIG. 11 is a cross-sectional view schematically illustrating a top ring of one embodiment. FIG. 12 is a cross-sectional view illustrating the partially enlarged top ring of the one embodiment. FIG. 13 is a perspective view illustrating a partially enlarged elastic seal member of the one embodiment. Since a top ring 2302 of this embodiment has a configuration similar to that of the top ring 302 of the embodiment of FIG. 3 to FIG. 5 excluding an elastic seal member 2336, description of the similar configuration will be omitted.

As illustrated in FIG. 11, the substrate suction member 330 includes the elastic seal member 2336 disposed to surround the porous member 334. In this embodiment, the elastic seal member 2336 is configured of a seal lip member having an approximately U-shaped cross section. Specifically, as illustrated in FIG. 12, the elastic seal member 2336 includes a base portion 2336-1, a lip portion 2336-2, and a coupling portion 2336-3.

The base portion 2336-1 is a frame-shaped member attached to the attaching surface 332-2*a* of the second shielding member 332-2 using any means, such as an adhesive or an adhesive double coated tape. The lip portion 2336-2 is a frame-shaped member provided to be spaced from the base portion 2336-1 below the base portion 2336-1. The coupling portion (coupling wall) 2336-3 is a frame-shaped member that couples an end portion of the base portion 2336-1 to an end portion of the lip portion 2336-2. The elastic seal member 2336 is a rectangular frame-shaped member corresponding to the quadrangular substrate WF, and includes the integrally formed base portion 2336-1, lip portion 2336-2, and coupling portion 2336-3. While FIG. 13 illustrates only a part of the elastic seal member 2336, the elastic seal member 2336 includes four linear side portions SI and four curved corner portions CO coupling the respective side portions SI. The elastic seal member 2336 is formed in a rectangular frame shape by coupling the respective side portions SI and the respective corner portions CO, and since there is no gap at which air leakage occurs, the sealing performance can be ensured.

As illustrated in FIG. 12, the elastic seal member 2336 is disposed at a peripheral area of the porous member 334 such that an opening is formed toward outside. In other words, the coupling portion (coupling wall) 2336-3 couples the end portion in the porous member 334 side of the base portion 2336-1 to the end portion in the porous member 334 side of the lip portion 2336-2. Therefore, the lip portion 2336-2 extends toward outside from the lower end of the coupling portion 2336-3. More specifically, in a state where the substrate WF is not suctioned to the porous member 334 (left side in FIG. 12), the lip portion 2336-2 extends obliquely downward from the lower end of the coupling portion 2336-3. The elastic seal member 2336 can be formed of, similarly to the above-described embodiment, a member that has elasticity and can shield the gas flow, for example, a silicone sponge or a silicone rubber. For the elastic seal member 2336, a soft material having chemical resistance, satisfactory stretchability, and a skin surface can be used.

The lip portion 2336-2 has a lower surface at which a contact surface 2336*a* brought in contact with the substrate WF is provided. That is, in a state where the substrate WF is suctioned to the porous member 334 (right side in FIG. 12), the substrate WF contacts the contact surface 2336*a* of the lip portion 2336-2 to push up the lip portion 2336-2. The elastic seal member 2336 is a member having elasticity, and suction of the substrate WF make an outside of the elastic seal member 2336 positive pressure. Therefore, the lip portion 2336-2 presses the substrate WF. This seals between the lip portion 2336-2 and the substrate WF. On the contact surface 2336*a* of the elastic seal member 2336, to avoid naturally adhering to be secured to the substrate WF (not to cause a blooming phenomenon), coating, such as fluororesin coating, for example, Teflon (registered trademark) processing using polytetrafluoroethylene as a material, may be performed. The contact surface 2336*a* of the elastic seal member 2336 may be coated by impregnation.

According to this embodiment, for example, as illustrated in the right side of FIG. 12, even when the outer peripheral portion of the surface to be suctioned of the substrate WF is partially depressed and a step WFa is formed, since the elastic seal member 2336 is provided, air leakage from a gap generated by the step WFa can be avoided. Therefore, according to this embodiment, the substrate WF can be reliably suctioned to the substrate suction member 330 regardless of the flatness of the surface to be suctioned of the substrate WF.

In addition, according to this embodiment, damaging the substrate WF due to a reactive force of the elastic seal member can be suppressed. That is, when a substrate that is easily broken and fragile (for example, a thin glass substrate) is suctioned and held, a reactive force of the contracted elastic seal member possibly damages the substrate. In contrast, since the elastic seal member 2336 of this embodiment is configured of a seal lip member having an approximately U-shaped cross section, the seal performance can be ensured while the reactive force against the substrate is suppressed to be low. As a result, according to this embodiment, damaging the substrate WF due to the reactive force of the elastic seal member can be suppressed, and the substrate WF can be reliably suctioned to the substrate suction member 330. The elastic seal member 2336 can be employed instead of the elastic seal member 1336 in the top ring 1302 illustrated in FIG. 10.

Figure 14:
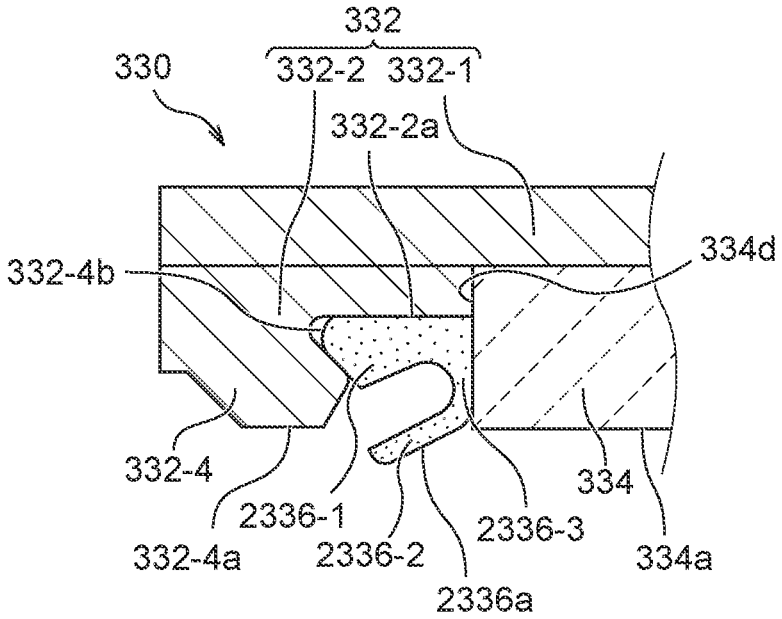
FIG. 14 is a cross-sectional view illustrating a partially enlarged top ring of one embodiment.
Figure 15:
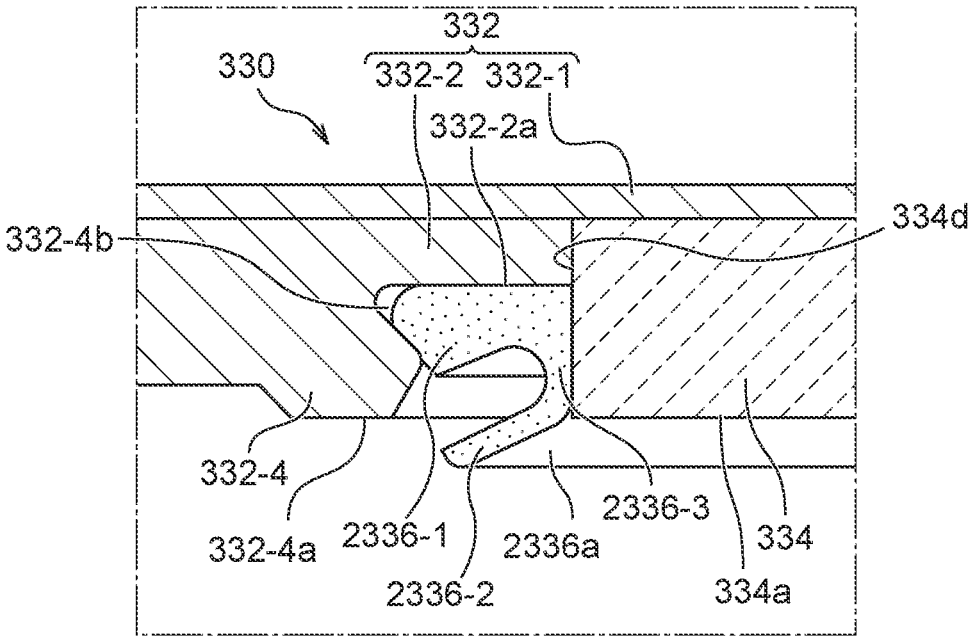
FIG. 15 is a cross-sectional view illustrating the partially enlarged top ring of the one embodiment.
Figure 16:
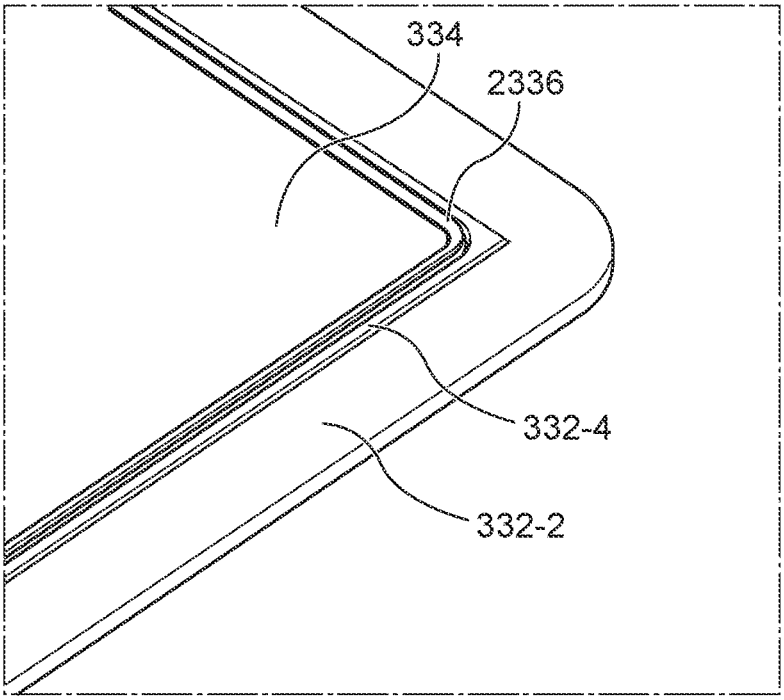
FIG. 16 is a perspective view illustrating a partially enlarged substrate suction member of the one embodiment.

Next, another modification of the top ring 2302 will be described. FIG. 14 is a cross-sectional view illustrating a partially enlarged top ring of one embodiment. FIG. 15 is a cross-sectional view illustrating the partially enlarged top ring of the one embodiment. FIG. 16 is a perspective view illustrating a partially enlarged substrate suction member of the one embodiment. Since the top ring of this embodiment has a configuration similar to that of the top ring 2302 of the embodiment of FIG. 11 to FIG. 13 excluding that a projecting portion is formed at the second shielding member, description of the similar configuration will be omitted.

As illustrated in FIG. 14 to FIG. 16, the second shielding member 332-2 includes a frame-shaped projecting portion 332-4 surrounding the elastic seal member 2336. The projecting portion 332-4 projects downward from the lower surface of the second shielding member 332-2. The projecting portion 332-4 includes a substrate holding surface 332-4*a* formed to be flush with the substrate suction surface 334*a* of the porous member 334.

As described in this embodiment, by forming the projecting portion 332-4 with the substrate holding surface 332-4*a* at the second shielding member 332-2, cracking of the outer most peripheral portion of the substrate can be suppressed. That is, in a case where the substrate holding surface 332-4*a* is not provided, when the substrate WF is pressed against the polishing pad 352 by the top ring suctioning and holding the substrate WF, the outer most peripheral portion (a portion in an outside of a portion in contact with the elastic seal member 2336) of the substrate WF warps due to the reactive force from the polishing pad 352 and possibly cracks. In contrast, in this embodiment, since the substrate holding surface 332-4*a* is formed at the projecting portion 332-4 provided in the outside of the elastic seal member 2336, warping of the outer most peripheral portion of the substrate WF can be suppressed. As a result, according to this embodiment, cracking at the outer most peripheral portion of the substrate can be suppressed.

The projecting portion 332-4 is formed to be inclined and project from the lower surface toward inside of the second shielding member 332-2 (in a direction of the elastic seal member 2336). As a result, the second shielding member 332-2 is provided with a groove 332-4*b* formed by the projecting portion 332-4 and the attaching surface 332-2*a*. The groove 332-4*b* is a groove to which the elastic seal member 2336 is fitted. By fitting a thick portion in the outside of the base portion 2336-1 to the groove 332-4*b*, the elastic seal member 2336 is fitted and secured to the second shielding member 332-2 over the whole circumference.

According to this embodiment, for example, the elastic seal member 2336 reaches the end of the product lifetime due to wear and the like, the elastic seal member 2336, which is a consumable part, can be easily replaced. That is, since the second shielding member 332-2 is provided with the groove 332-4*b* to which the elastic seal member 2336 is fitted, at a site on which the substrate processing apparatus 1000 is installed, a general worker can easily attach the elastic seal member 2336 to the second shielding member 332-2.

While several embodiments of the present invention have been described above, the above-described embodiments of the present invention are intended to facilitate understanding of the present invention and are not intended to limit the present invention. The present invention may be modified and improved without departing from its spirit, and it goes without saying that the present invention includes equivalents of the present invention. To the extent that at least part of the above-described problems can be solved, or at least part of the effect can be achieved, any combination or omission of each component described in the claims and specification is possible.

This application discloses, as one embodiment, a substrate suction member including a porous member, a shielding member, and a frame-shaped elastic seal member. The porous member includes a substrate suction surface for suctioning a substrate and a pressure reducer communicating with pressure reducing means. The shielding member includes a first shielding member configured to shield a surface in an opposite side of the substrate suction surface of the porous member and a frame-shaped second shielding member configured to shield at least a part of a side surface of the porous member. The elastic seal member is attached to the second shielding member so as to surround the porous member and provided with a contact surface in contact with the substrate.

Furthermore, this application discloses, as one embodiment, the substrate suction member in which the second shielding member is configured such that the substrate suction surface of the porous member projects beyond an attaching surface of the second shielding member for attaching the elastic seal member to the second shielding member, and the elastic seal member is disposed to surround a side surface of the porous member projecting beyond the attaching surface of the second shielding member.

Furthermore, this application discloses, as one embodiment, the substrate suction member in which the elastic seal member includes a first elastic seal member surrounding the side surface of the porous member projecting beyond the attaching surface of the second shielding member and a second elastic seal member provided at an outside of the first elastic seal member with an interval.

Furthermore, this application discloses, as one embodiment, the substrate suction member in which the shielding member further includes a frame-shaped third shielding member provided at a lower portion of the second shielding member and located at an outside of the elastic seal member with an interval, and the first shielding member and the second shielding member are provided with a fluid flow passage to discharge a fluid to a space between the elastic seal member and the third shielding member.

Furthermore, this application discloses, as one embodiment, the substrate suction member in which the elastic seal member includes a base portion attached to the attaching surface of the second shielding member, a lip portion provided below the base portion with an interval, and a coupling portion coupling the base portion to the lip portion, and the contact surface is formed at a lower surface of the lip portion.

Furthermore, this application discloses, as one embodiment, the substrate suction member in which the second shielding member includes a frame-shaped projecting portion surrounding the elastic seal member, and the projecting portion includes a substrate holding surface formed to be flush with the substrate suction surface of the porous member.

Furthermore, this application discloses, as one embodiment, the substrate suction member in which the second shielding member is provided with a groove formed by the projecting portion and the attaching surface, the elastic seal member is fitted to the groove, and the elastic seal member is attached to the second shielding member by fitting the base portion to the groove.

Furthermore, this application discloses, as one embodiment, the substrate suction member in which the elastic seal member is formed in a rectangular frame shape having four linear side portions.

Furthermore, this application discloses, as one embodiment, an elastic seal assembly attached to a substrate suction member including a porous member and a shielding member. The porous member includes a substrate suction surface for suctioning a substrate and a pressure reducer communicating with pressure reducing means. The shielding member includes a first shielding member configured to shield a surface in an opposite side of the substrate suction surface of the porous member and a frame-shaped second shielding member configured to shield at least a part of a side surface of the porous member. The elastic seal assembly includes a frame-shaped fixing frame and a frame-shaped elastic seal member. The fixing frame is attached to the second shielding member so as to surround the porous member. The elastic seal member is attached to a surface in an opposite side of a fixing surface attached to the second shielding member of the fixing frame. The elastic seal member includes a contact surface in contact with the substrate.

Furthermore, this application discloses, as one embodiment, a top ring for holding a substrate. The top ring includes a rotation shaft, a base member coupled to the rotation shaft, and the substrate suction member according to any of the above-described embodiments attached to the base member or a substrate suction member to which the above-described elastic seal assembly is attached.

Furthermore, this application discloses, as one embodiment, the top ring further including an abrasive grain cleaning member configured to supply a fluid to a surface in an opposite side of the substrate suction surface of the porous member via a flow passage formed at the base member and the shielding member.

Furthermore, this application discloses, as one embodiment, a substrate processing apparatus including a polishing table, the top ring according to any of the above-described embodiments, and a polishing liquid supply nozzle. A polishing pad with a polishing surface is attached to the polishing table. The top ring is configured to hold a substrate and press the substrate against the polishing surface. The polishing liquid supply nozzle is configured to supply a polishing liquid on the polishing pad.

REFERENCE SIGNS LIST

18 . . . top ring shaft (rotation shaft)
31 . . . pressure reducing means (vacuum source)
33 . . . abrasive grain cleaning member
34 . . . fluid supply member
301 . . . base member
302 . . . top ring
303 . . . flange
305 . . . spacer
306 . . . carrier
330 . . . substrate suction member
332 . . . shielding member
332-1 . . . first shielding member
332-2 . . . second shielding member
332-2*a* . . . attaching surface
332-3 . . . third shielding member
332-4 . . . projecting portion
332-4*a* . . . substrate holding surface
332-4*b* . . . groove
332*a* . . . fluid flow passage
333 . . . flow passage
334 . . . porous member
334*a* . . . substrate suction surface
334*b* . . . pressure reducer
334*c* . . . surface in opposite side
334*d* . . . side surface
336, 1336, 2336 . . . elastic seal member
336-1 . . . first elastic seal member
336-2 . . . second elastic seal member
336*a* . . . contact surface
337 . . . space
1000 . . . substrate processing apparatus
2336-1 . . . base portion
2336-2 . . . lip portion
2336-3 . . . coupling portion
WF . . . substrate
WFa . . . step

The invention claimed is:

1. A substrate suction member comprising:

a porous member including a substrate suction surface for suctioning a substrate and a pressure reducer communicating with pressure reducing means;

a shielding member including a first shielding member configured to shield a surface in an opposite side of the substrate suction surface of the porous member and a frame-shaped second shielding member configured to shield at least a part of a side surface of the porous member; and a frame-shaped elastic seal member attached to the second shielding member so as to surround the porous member and provided with a contact surface in contact with the substrate.

2. The substrate suction member according to claim 1, wherein the second shielding member is configured such that the substrate suction surface of the porous member projects beyond an attaching surface of the second shielding member for attaching the elastic seal member to the second shielding member, and the elastic seal member is disposed to surround a side surface of the porous member projecting beyond the attaching surface of the second shielding member.

3. The substrate suction member according to claim 2, wherein the elastic seal member includes a first elastic seal member surrounding the side surface of the porous member projecting beyond the attaching surface of the second shielding member and a second elastic seal member provided at an outside of the first elastic seal member with an interval.

4. The substrate suction member according to claim 2, wherein the shielding member further includes a frame-shaped third shielding member provided at a lower portion of the second shielding member and located at an outside of the elastic seal member with an interval, and the first shielding member and the second shielding member are provided with a fluid flow passage to discharge a fluid to a space between the elastic seal member and the third shielding member.

5. The substrate suction member according to claim 2, wherein the elastic seal member includes a base portion attached to the attaching surface of the second shielding member, a lip portion provided below the base portion with an interval, and a coupling portion coupling the base portion to the lip portion, and the contact surface is formed at a lower surface of the lip portion.

6. The substrate suction member according to claim 5, wherein the second shielding member includes a frame-shaped projecting portion surrounding the elastic seal member, and the projecting portion includes a substrate holding surface formed to be flush with the substrate suction surface of the porous member.

7. The substrate suction member according to claim 6, wherein the second shielding member is provided with a groove formed by the projecting portion and the attaching surface, the elastic seal member is fitted to the groove, and the elastic seal member is attached to the second shielding member by fitting the base portion to the groove.

8. The substrate suction member according to claim 1, wherein the elastic seal member is formed in a rectangular frame shape having four linear side portions.

9. An elastic seal assembly attached to a substrate suction member including a porous member and a shielding member, the porous member including a substrate suction surface for suctioning a substrate and a pressure reducer communicating with pressure reducing means, the shielding member including a first shielding member configured to shield a surface in an opposite side of the substrate suction surface of the porous member and a frame-shaped second shielding member configured to shield at least a part of a side surface of the porous member, the elastic seal assembly comprising:

a frame-shaped fixing frame attached to the second shielding member so as to surround the porous member; and a frame-shaped elastic seal member attached to a surface in an opposite side of a fixing surface attached to the second shielding member of the fixing frame, the elastic seal member having a contact surface in contact with the substrate.

10. A top ring for holding a substrate, comprising:

a rotation shaft;

a base member coupled to the rotation shaft; and the substrate suction member according to claim 1 attached to the base member or a substrate suction member to which the elastic seal assembly according to claim 9 is attached.

11. The top ring according to claim 10, further comprising an abrasive grain cleaning member configured to supply a fluid to a surface in an opposite side of the substrate suction surface of the porous member via a flow passage formed at the base member and the shielding member.

12. A substrate processing apparatus comprising:

a polishing table to which a polishing pad with a polishing surface is attached;

the top ring according to claim 10 configured to hold a substrate and press the substrate against the polishing surface; and a polishing liquid supply nozzle configured to supply a polishing liquid on the polishing pad.

* * * * *